US006352166B1

(12) United States Patent
Copeland

(10) Patent No.: US 6,352,166 B1
(45) Date of Patent: Mar. 5, 2002

(54) SELF-CLOSING LID APPARATUS

(75) Inventor: Bruce W. Copeland, Stone Mountain, GA (US)

(73) Assignee: William Industries, Inc., Shelbyville, IN (US)

( * ) Notice: Subject to any disclaimer, the term of this patent is extended or adjusted under 35 U.S.C. 154(b) by 0 days.

(21) Appl. No.: 09/501,754

(22) Filed: Feb. 10, 2000

Related U.S. Application Data

(60) Provisional application No. 60/119,445, filed on Feb. 10, 1999.

(51) Int. Cl.[7] ..... B65D 51/18

(52) U.S. Cl. ..... 220/254; 215/387; 220/361; 220/710.5; 220/714; 220/715; 222/484; 222/472; 222/469; 251/339

(58) Field of Search ..... 222/481.5, 484, 222/548, 555, 470, 472, 505, 469; 215/387; 220/710.5, 711, 713–715, 719, 254, 256, 255, 361, 367.1, 203.06, 203.7; 251/339

(56) References Cited

U.S. PATENT DOCUMENTS 1,769,815 A * 7/1930 Wilson
2,269,127 A * 1/1942 Riley
2,274,849 A * 3/1942 Peterson
2,353,132 A * 7/1944 Frank
2,380,906 A * 7/1945 Gessler
2,447,870 A * 8/1948 Polcyn
2,571,843 A * 10/1951 Dale
2,574,338 A * 11/1951 Lewis
2,586,455 A * 2/1952 Coskey ..... 251/339 X
2,718,338 A * 9/1955 Cicero
3,262,612 A * 7/1966 Tabor
3,402,847 A 9/1968 Bridenstine
3,507,255 A * 4/1970 Allen ..... 251/339 X
3,635,380 A * 1/1972 Fitzgerald
3,703,979 A * 11/1972 Douty ..... 222/484
3,739,938 A * 6/1973 Paz
4,094,433 A * 6/1978 Numbers
4,099,642 A * 7/1978 Nergard
4,127,212 A * 11/1978 Waterbury
4,133,446 A * 1/1979 Albert
4,136,799 A * 1/1979 Albert
4,171,060 A * 10/1979 Howard et al.
4,212,408 A * 7/1980 Valenzona
4,258,666 A * 3/1981 Edstrom
4,276,992 A * 7/1981 Susich
4,303,173 A * 12/1981 Negard
4,342,419 A * 8/1982 Conway
4,712,704 A * 12/1987 Ramsey et al. ..... 220/254
4,750,644 A * 6/1988 Kolody (List continued on next page.)

OTHER PUBLICATIONS

Photographs of "Gerber" lid and insert (Feb. 23, 2000, Photos 1–5, Sheets 1–3) (Note: insert marked as "pat. pend.").
Photographs of "the first years" lid and insert (Feb. 23, 2000, Photos 6–11, Sheets 4–6).
Photographs of Playtex lid and insert (Feb. 23, 2000, Photo 12–17, Sheets 7–9).

*Primary Examiner*—Allan N. Shoap
*Assistant Examiner*—Robin Hylton
(74) *Attorney, Agent, or Firm*—Barnes & Thornburg

(57) ABSTRACT

A lid for a container having an opening is configured to close the opening. The lid includes a base adapted to fit the container opening and an actuator configured to engage the base. The base includes a deformable portion which, when deformed, will pass the contents of the container therethrough. The actuator is moveable between a closing position and an opening position and is operable to deform the deformable portion such that, when the actuator is in its closing position, the contents of the container are blocked from passing through the deformable portion and, when the actuator is in its opening position, the contents of the container will pass through the deformable portion.

55 Claims, 8 Drawing Sheets

U.S. PATENT DOCUMENTS 5,036,993 A 8/1991 Ramsey
5,072,849 A * 12/1991 Blau
5,082,134 A 1/1992 Ramsey
5,118,014 A * 6/1992 Hestehave et al.
5,123,574 A 6/1992 Poulos
5,143,248 A 9/1992 Sawatsky
5,150,816 A * 9/1992 DeCastro ..... 220/711
5,169,016 A 12/1992 Hinz, Jr.
5,186,353 A 2/1993 Ramsey
5,222,623 A * 6/1993 Eger et al.
5,242,075 A 9/1993 Ott et al.
5,257,773 A * 11/1993 yoshimoto et al. ..... 251/339
5,269,432 A 12/1993 Beckertgis
5,273,194 A * 12/1993 McNamara
5,294,014 A 3/1994 Wyatt et al.
5,320,253 A * 6/1994 Robinson
5,477,980 A * 12/1995 Chaffin ..... 220/715
5,573,139 A * 11/1996 Yeh
5,607,073 A * 3/1997 Forrer
5,615,808 A * 4/1997 Huang
5,680,951 A 10/1997 Feltman, III et al.
5,947,343 A * 9/1999 Horstmann
6,003,711 A * 12/1999 Bilewitz ..... 220/254 X
6,010,029 A * 1/2000 Wang ..... 220/254 X
6,098,834 A * 8/2000 Hatsumoto et al.
6,202,877 B1 * 3/2001 La Torre ..... 220/254
6,216,903 B1 * 4/2001 Hirose et al. ..... 220/713 X

* cited by examiner

SELF-CLOSING LID APPARATUS

This application claims priority under 35 U.S.C. § 119(e) to U.S. Provisional Application Serial No. 60/119,445, filed Feb. 10, 1999, which is expressly incorporated by reference herein.

BACKGROUND AND SUMMARY OF THE INVENTION

The present invention relates to a self-closing lid for a container. The lid includes an aperture and an actuator that is moved to operate the aperture to dispense the contents of the container. The self-closing lid of the present invention may be used, for example, to dispense fluid, and, specifically, beverages for consumption. It is to be understood that the self-closing lid of the present invention is not limited to being used as a beverage dispenser but may be used to dispense other types of materials, such as non-liquids, powders, granulated materials, pelletized materials, etc., from any type of container, if desired.

The ability to mass produce self-closing lids cost-efficiently depends upon many factors. Such cost-efficiency factors include, for example, the number of parts that comprise the self-closing lid, the types of materials of which the self-closing lid is made, and the quantity of such materials. Optimizing any of these cost-efficiency factors may offer competitive advantages. The current invention presents a self-closing lid that minimizes the number of parts that form the self-closing lid. Furthermore, the bulk of the material used in the self-closing lid (i.e., polypropylene) is cost-efficient compared to other materials such as polycarbonate. Moreover, the amount of the most expensive material (i.e., polyolefin) used in the self-closing lid is limited to enhance the cost-efficiency of producing the self-closing lid.

The lid of the present invention comprises a base adapted to fit a container, an actuator coupled to the base and including a body portion and a projection extending away from the body portion, and a resilient seal coupled to the base. The resilient seal is arranged to form a projection-receiving aperture. The projection is inserted in the projection-receiving aperture. The projection is coupled to the resilient seal to form a flow-tight seal therewith when the actuator is normally positioned in a closed position relative to the base. The projection is coupled to the resilient seal to deform the resilient seal relative to the closed position to form a flow passage therebetween when the actuator is positioned in an opened position relative to the base.

In another embodiment of the present invention, the lid comprises a base adapted to extend across an opening of a container and to couple to the container to form a flow-tight seal therewith, an actuator coupled to the base and including a projection, and a resilient seal coupled to the base. The projection is coupled to the resilient seal to form a flow-tight seal therewith when the actuator is normally positioned in a closed position relative to the base. The projection deforms the resilient seal relative to the closed position to form a flow passage therebetween when the actuator is positioned in an opened position relative to the base. The resilient seal biases the actuator toward the closed position.

In another embodiment of the present invention, the lid comprises a base adapted to extend across an opening of a container and to couple to the container to form a flow-tight seal therewith, a resilient seal coupled to the base and formed to include an aperture, and actuation means, including a projection that is positioned to lie within the aperture and is coupled to the resilient seal, for deforming the resilient seal between a normal no-flow position when the projection couples to the resilient seal to form a flow-tight seal therewith and a flow position when the projection deforms the resilient seal relative to the no-flow position to form a flow passage therebetween.

In yet another alternative embodiment of the invention, the lid is adapted for a container having an opening and proportioned and designed to close the opening. The lid comprises a base adapted to fit the container opening, the base having a deformable portion which, when deformed, will pass the contents of the container therethrough, and an actuator configured to engage the base and being moveable between a closing position and an opening position, the actuator being operable to deform the deformable portion such that, when the actuator is in its closing position, the contents of the container are blocked from passing through the deformable portion and, when the actuator is in its opening position, the contents of the container will pass through the deformable portion.

Additional objects, features, and advantages of the present invention will become apparent to those skilled in the art upon consideration of the following detailed description of the invention.

BRIEF DESCRIPTION OF THE DRAWINGS

The detailed description particularly refers to the accompanying figures in which.

DETAILED DESCRIPTION OF THE DRAWINGS

Figure 1:
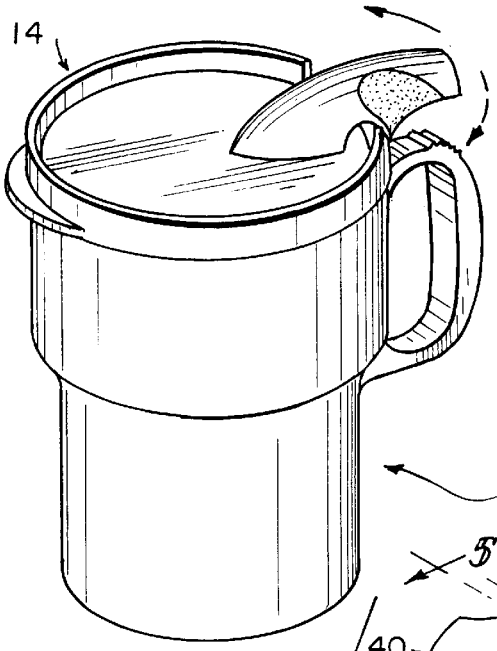
FIG. 1 is a perspective view of a beverage container including a receptacle and a self-closing lid coupled to the receptacle.

An upstanding container 10 including a receptacle 12 and a self-closing lid 14 according to the present invention is shown, for example, in FIG. 1. Receptacle 12 is formed to include an interior region for holding the contents of container 10. Lid 14 is coupled to receptacle 12 to dispense the contents of container 10 from the interior region of receptacle 12 through one of a first resilient seal 16 and a second resilient seal 18, shown in FIG. 2, to the exterior region of receptacle 12 in a controlled fashion.

For all embodiments of the present invention, the lid is self-closing so that the lid is normally positioned in a closed, or no-flow, position by at least one resilient seal of the lid so that the lid prohibits the contents of the container from passing out of the receptacle. A user can apply an actuating force sufficient to move the lid to an opened position. In so doing, the at least one resilient seal is deformed so that the contents of the container can pass through the at least one resilient seal out of the receptacle. (The term "deform" in this specification refers to altering the size or shape, or both, of an object.) Upon removal of the actuating force, the at least one resilient seal automatically urges the lid back to the closed position.

In a preferred embodiment of the present invention, container 10 is a drinking mug, for example, and the interior region of receptacle 12 holds beverages for consumption by a user. Receptacle 12 includes an opening permitting beverages to be poured into the interior region or removed from the interior region. Lid 14 is coupled to an upper end of receptacle 12 to cover the opening of receptacle 12.

Figure 2:
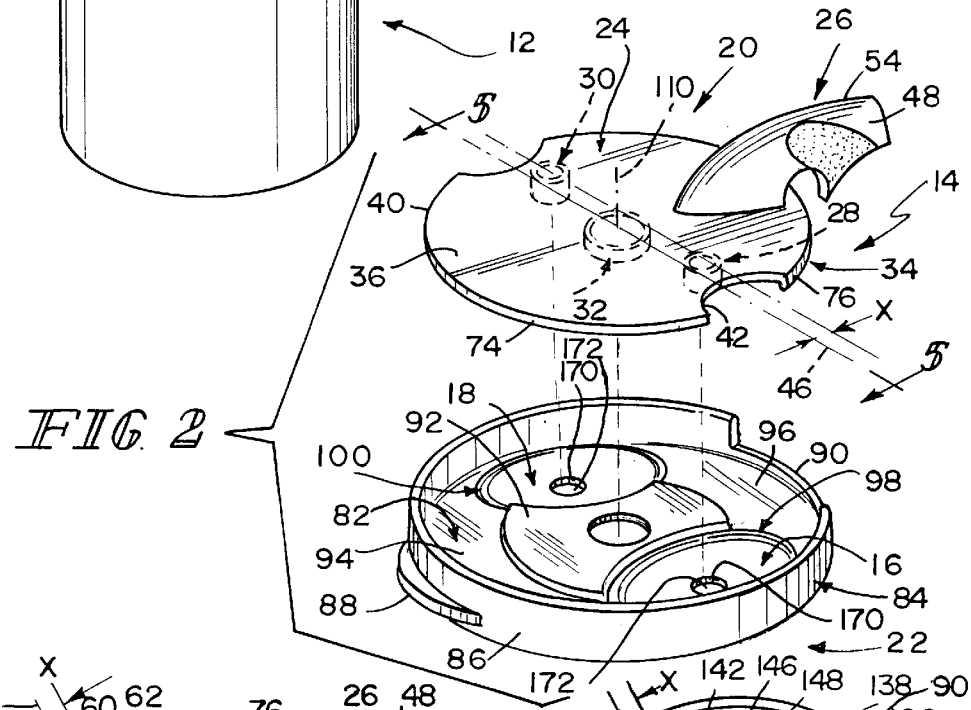
FIG. 2 is a perspective exploded view of the lid of FIG. 1 showing the lid including a "rotation-action" actuator, a base, and a pair of elliptical resilient seals, the actuator including a body portion formed to include a pair of curved notches, a lever, pair of projections (shown in phantom), and a connector (shown in phantom), the centers of the pair of projections being slightly offset from a diametrical axis of the body portion that extends between the mid-points of curved notches and through the center of body portion and aligning with a pair of projection-receiving apertures formed within the resilient seals when the actuator is closed, the connector aligning with a connector-receiving aperture formed within the base.

Lid 14 includes a rigid "rotation-action" actuator 20 (or actuation means), a rigid base 22, first resilient seal 16, and second resilient seal 18 as shown in FIG. 2. Actuator 20 is rotatably coupled to base 22 and movably coupled to resilient seals 16, 18. Base 22 is coupled to receptacle 12 to provide a flow-tight seal therewith. Resilient seals 16, 18 are chemically and heat bond to base 22. That lid 14 requires so few parts enhances the cost-efficiency of lid 14.

The materials used for lid 14 and the relative quantities of such materials enhance the cost-efficiency of lid 14. Both actuator 20 and base 22 are made of a thermoplastic material. The currently preferred material of actuator 20 and base 22 is polypropylene. Polypropylene is a rather inexpensive material compared to such materials as polycarbonate, which aids in reducing the overall cost of lid 14 especially considering that actuator 20 and base 22 form much of the structure of lid 14. It is to be understood that actuator 20 and base 22 can also be made of polyethylene. Resilient seals 16, 18 are made of an elastomeric material. The currently preferred material for resilient seals 16, 18 is polyolefin. Although the cost of the material of resilient seals 16, 18 is typically greater than the cost of the materials of actuator 20 and base 22, the cost of the material of resilient seals 16, 18 is minimized since resilient seals 16, 18 require less material than actuator 20 or base 22. It is to be understood that the use of other elastomeric materials, such as silicone and polystyrene, for resilient seals 16, 18 is within the scope of the present invention.

Figure 3:
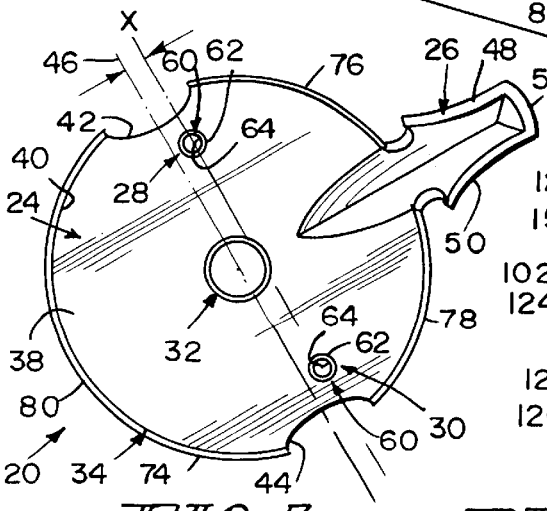
FIG. 3 is a bottom view of the actuator of FIG. 2.

Actuator 20 integrally includes a horizontal, generally circular body portion 24, a lever 26, first projection 28, second projection 30, a connector 32, and a perimeter lip 34 as shown in FIG. 3. Actuator 20 provides an ergonomic mechanism for opening lid 14.

Body portion 24 is configured to nest within base 22 and includes an upper surface 36, a lower surface 38, and a generally circular perimeter edge 40 as shown in FIGS. 2 and 3. Upper and lower surfaces 36, 38 are substantially flat. Perimeter edge 40 is formed to include a pair of curved notches 42, 44 that are positioned to lie in diametrical opposition to each other so that the centers of curved notches 42, 44 (i.e., the mid-points along the respective position of perimeter edge 40 that forms curved notches 42, 44) are positioned to lie along a diametrical axis 46 of body portion 24 (hereinafter referred to as actuator diametrical axis 46). Taking lever 26 to lie at the six o'clock position, actuator diametrical axis 46 extends between the three o'clock and nine o'clock positions.

Lever 26 includes a first wall 48, a second wall 50, an end wall 52, and a curved top edge 54 as shown in FIGS. 2 and 3. Top edge 54 curves upwardly away from upper surface 36 of body portion 24 of actuator 20 and radially outwardly to end wall 52. Top edge 54 joins the tops of first and second walls 48, 50 that are fixedly coupled to upper surface 36 of body portion 24 of actuator 20 and extend upwardly from and radially outwardly from upper surface 36 of body portion 24 to end wall 52. End wall 52 extends downwardly from top edge 54 and between first and second walls 48, 50.

Figure 5:
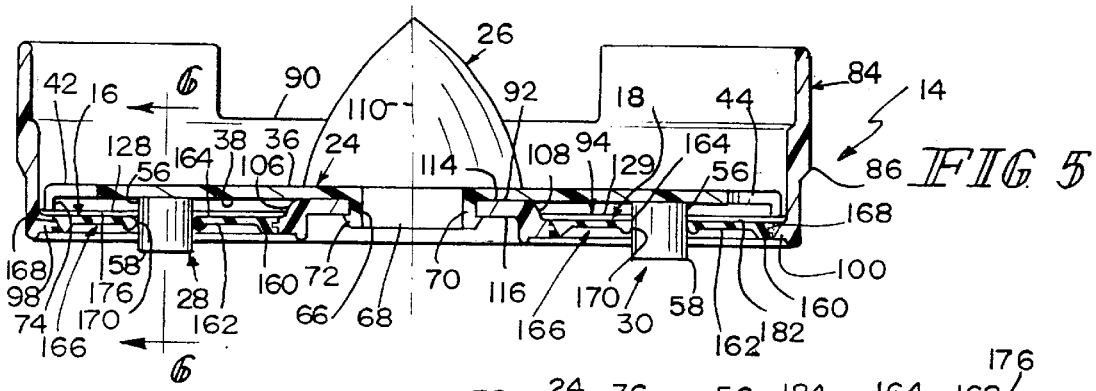
FIG. 5 is a sectional view of the lid taken along line 5—5 of FIG. 2 showing the connector positioned to lie in the connector-receiving aperture to couple the body portion of the actuator to the base, the body portion of the actuator and the plate of the base cooperating to form a chamber therebetween permitting communication between the curved notches and the resilient seals, the projections being positioned to lie in the projection-receiving apertures defined by the resilient seals to form a flow-tight seal therewith.
Figure 6:
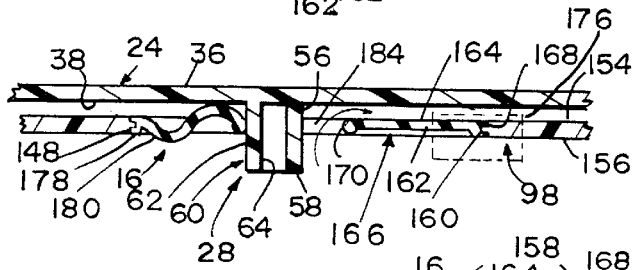
FIG. 6 is a sectional view of the lid along line 6—6 of FIG. 5, with portions taken away, showing one of the projections and one of the resilient seals in the opened position, the projection having stretched the resilient seal to enlarge the projection-receiving aperture relative to the closed position to form a flow passage therebetween to permit fluid to flow through the resilient seal.

Projections 28, 30 each include a proximal end 56, a distal end 58, and a wall 60 extending between proximal and distal ends 56, 58 as shown in FIGS. 3, 5, and 6. Proximal ends 56 are fixedly coupled to lower surface 38 of body portion 24. Walls 60 are cylindrically-shaped so that the cross-section of each projection 28, 30 is circular. Walls 60 each include an outer surface 62 and an inner surface 64 such that outer surface 62 has a diameter greater than inner surface 64.

Each projection 28, 30 is positioned to lie adjacent to respective curved notch 42, 44 of body portion 24 as shown in FIG. 3. Projections 28, 30 are positioned to lie radially equidistant from the center of body portion 24. The centers of projections 28, 30 are positioned to lie a distance X perpendicularly away from actuator diametrical axis 46 so that projections are slightly offset from actuator diametrical axis to properly align curved notches 42, 44 during operation of lid 14 as is explained below. Furthermore, projections 28, 30 are positioned to lie in the same semi-circular portion of body portion 24 relative to actuator diametrical axis 46.

Connector 32 includes a proximal end 66, a distal end 68, a cylindrically-shaped wall 70, and a ridge 72 as shown in FIG. 5. Connector 32 is positioned to lie in concentric relation to perimeter edge 40 of body portion 24. Proximal end 66 is coupled to lower surface 38 of body portion 24 of actuator 20. Wall 70 extends between proximal and distal ends 66, 68. Ridge 72 is coupled to wall at distal end 68 of connector 32 and extends radially outwardly from and circumferentially around wall 70.

Perimeter lip 34 is coupled to and extends downwardly from a segments of perimeter edge 40 of body portion 24 of actuator 20 as shown in FIG. 3. Perimeter lip 34 includes first, second, and third portions 74, 76, 78. Curved notches 42, 44 physically separate first portion 74 from second and third portions 76, 78. Lever 26 physically separates second portion 76 from third portion 78. Each of first, second, and third portions 74, 76, 78 of perimeter lip includes an end surface 80.

Figure 4:
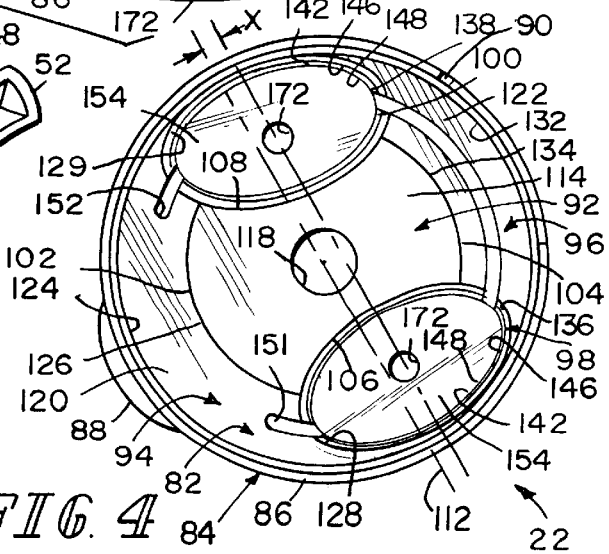
FIG. 4 is a top plan view of the base and the pair of resilient seals of FIG. 2, the base including a circular plate and a rim, the resilient seals being slightly offset from a diametrical axis of the plate.

Base 22 integrally includes a horizontal circular plate 82 extending across the opening of receptacle 12 and a rim 84 coupling to the perimeter of plate 82 as shown in FIG. 4.

Rim 84 couples base 22 to receptacle 12 in a conventional manner so that a flow-tight seal is formed between rim 84 and receptacle 12. Various mechanisms for coupling base 22 to receptacle 12 are well-known to one skilled in the art. This being so, such coupling will not be described in detail in this specification.

Rim 84 includes a wall 86 and a nosepiece 88 as shown in FIG. 2. Wall 86 of rim 84 couples to and extends upwardly from and circumferentially around the perimeter of plate 82. Wall 86 conventionally couples to the upper end of receptacle 12 to form a substantially flow-tight seal with receptacle 12. Wall of rim 84 is formed to include a U-shaped notch 90 that is positioned to lie diametrically opposite nosepiece 88 and limits the movement of lever 26 relative to base 22. Nosepiece 88 protrudes radially outwardly from wall 86 and provides a platform for a user's fingers to dislodge base 22 from receptacle 12.

Plate 82 includes an inner plateau 92, a first outer plateau 94, a second outer plateau 96, a first well 98, and a second well 100 as shown in FIG. 4.

Inner plateau 92 is defined by first and second convex walls 102, 104 and first and second concave walls 106, 108. First and second convex walls 102, 104 are positioned to lie in diametrical opposition to each other around a central axis 110 extending through the center of plate 82. First convex wall 102 is longer than second convex wall 104. Taking the radially outermost point of nosepiece 88 relative to central axis 110 to lie at the twelve o'clock position, first and second concave walls 106, 108 are positioned so that the mid-points of first and second concave walls 106, 108 are slightly offset an equal distance from an axis 112 of plate 82 that extends between the three o'clock and nine o'clock positions of plate 82 through central axis 110 (axis 112 being hereinafter referred to as plate diametrical axis 112).

Inner plateau 92 includes an upper surface 114 and a lower surface 116 and is formed to include a circular connector-receiving aperture 118 that is centered in plate 82 so that central axis 110 passes through the center of connector-receiving aperture 118 as shown in FIG. 5. Connector-receiving aperture 118 is sized to receive connector 32 of actuator 20. Upper surface 114 of inner plateau 92 is positioned to lie in sliding bearing contact with lower surface 38 of body portion 24 of actuator 20.

Inner plateau 92 couples to connector 32 of actuator 20 as shown in FIG. 5. Ridge 72 of connector 32 has a slightly larger diameter than the diameter of connector-receiving aperture 118. In coupling connector 32 to inner plateau 92, connector 32 is positioned over connector-receiving aperture 118 and actuator 20 is pressed onto inner plateau 92 so that ridge 72 slips through connector-receiving aperture 118 and couples to lower surface 116 of inner plateau 92 to provide a snap connection between actuator 20 and base 22 and to rotatably couple actuator 20 to base 22. In this position, body portion 24 and plate 82 share central axis 110 as a common axis extending through the centers thereof. Body portion 24 rotates around central axis 110.

Outer plateaus 94, 96 are arcuately-shaped and positioned to lie in concentric relation to convex walls 102, 104 and connector-receiving aperture 118 as shown in FIG. 4. Each outer plateau 94, 96 includes an upper surface 120, 122 that is positioned to lie in co-planar relation to each other. Upper surfaces 120, 122 are positioned to lie lower than upper surface 114 of inner plateau 92. Upper surface 120 of first outer plateau 94 is positioned to lie in sliding bearing contact with end surface 80 of first portion 74 of perimeter lip 34 of actuator 20. Upper surface 122 of second outer plateau 96 is positioned to lie in sliding bearing contact with end surfaces 80 of second and third portions 76, 78 of perimeter lip 34 of actuator 20. The sliding bearing contact provided between upper surfaces 120, 122 of outer plateaus 94, 96 and end surfaces 80 of perimeter lip 34 helps to rigidify and keep flat body portion 24 of actuator 20.

First outer plateau 94 includes an outer edge 124, an inner edge 126, a first concave wall 128, and a second concave wall 129. A portion of the perimeter of plate 82 defines outer edge 124. First convex wall 102 of inner plateau 92 defines inner edge 126 of first outer plateau 94. First concave wall 128 extends between outer and inner edges 124, 126 at one end of first outer plateau 94 and outer and inner edges 124, 126 at an opposite end of first outer plateau 94.

Second outer plateau 96 includes an outer edge 132, an inner edge 134, a first concave wall 136, and a second concave wall 138. A portion of the perimeter of plate 82 defines outer edge 132. Second convex wall 104 of inner plateau 92 defines inner edge 134 of second outer plateau 96. First concave wall 136 extends between outer and inner edges 132, 134 at one end of second outer plateau 96 and outer and inner edges 132, 134 at an opposite end of second outer plateau 96.

Wells 98, 100 are elliptically-shaped and each is formed to include an elliptically-shaped seal-receiving aperture 142 as shown in FIG. 4. Wells 98, 100 are positioned to lie in spaced-apart co-planar relation to each other. The centers of wells are positioned to lie radially equidistant from central axis 110 and perpendicularly equidistant from plate diametrical axis 112 so that wells 98, 100 are slightly offset from plate diametrical axis 112. Furthermore, the centers of wells are positioned to lie in the same semi-circular portion of plate 82 as second outer plateau 96 relative to plate diametrical axis 112.

First well 98 includes an outer edge 146, an inner edge 148, an upper surface 154, and a lower surface 156. A portion of the perimeter of plate 82, first concave wall 128 of first outer plateau 94, first concave wall 106 of inner plateau 92, and first concave wall 136 of second outer plateau 96 cooperate to define outer edge 146 of first well 98. Upper surface 154 extends between outer edge 146 and inner edge 148 and is positioned to lie lower than inner plateau 92 and outer plateaus 94, 96. Inner edge 148 defines seal-receiving aperture 142 and includes a tongue 158 that extends around inner edge 148. Tongue 158 provides additional surface area to which resilient seal 16 couples. Inner edge 148 is positioned to lie in concentric relation to outer edge 146.

Second well 100 is structurally similar to first well 98 so that like reference numbers refer to like structures. A portion of the perimeter of plate 82, second concave wall 129 of first outer plateau 94, second concave wall 108 of inner plateau 92, and second concave wall 138 of second outer plateau 96 cooperate to define outer edge 146 of second well 100. Upper surface 154 of second well 100 is positioned to lie lower than inner plateau 92 and outer plateaus 94, 96. Inner edge 148 of second well 100 defines seal-receiving aperture 142 of second well 100 and includes tongue 158 that extends around inner edge 148. Inner edge 148 is positioned to lie in concentric relation to outer edge 146.

Resilient seals 16, 18 each nests within respective seal-receiving aperture 142 and couple to inner edge 148 of respective well 98, 100 as shown in FIGS. 4–7. Resilient seals 16, 18 are positioned to lie horizontally and in co-planar relation to each other. Because resilient seals 16, 18 are made of an elastomeric material, resilient seals 16, 18 possess the quality of being resilient so that resilient seals 16, 18 have the ability to deform when influenced by a deforming force or stress and to substantially recover their size and shape when the deforming force or stress is removed. The material of resilient seals 16, 18 may possess a minimal amount of memory so that resilient seals 16, 18 may experience some change in size and shape after being repeatedly or continuously deformed. The elastomeric material of resilient seals 16, 18 are also somewhat soft so that each resilient seal is able to conform, at least in part, to the shape of that which deforms it.

Figure 7:
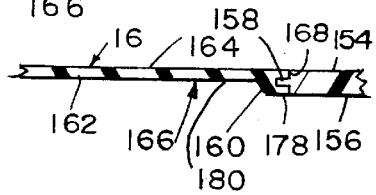
FIG. 7 is an enlarged sectional view of the area within the dashed box of FIG. 6 showing a portion of one of the resilient seals connected to a well of the base.

First resilient seal 16 includes a rim region 160, a web region 162, an upper surface 164, and a lower surface 166 as shown in FIGS. 5–7. Rim region 160 is positioned to lie along the perimeter of web region 162. Rim region 160 includes an outer portion 168 that bonds to inner edge 148 of first well 98 as previously described. Web region 162 includes an inner portion 170 that defines a projection-receiving aperture 172. First projection 28 nests within projection-receiving aperture 172. The diameter of outer surface 62 of wall 60 of first projection 28 is slightly greater than the diameter of projection-receiving aperture 172 when nothing is positioned in projection-receiving aperture 172 so that first projection 28 couples to inner portion 170 to form a flow-tight seal therewith when actuator 20 is closed. Upper surface 164 of first resilient seal 16 is generally flat and is positioned to lie flush with upper surface 154 of first well 98 so that upper surfaces 154 and 164, first concave walls 106, 128, and 136, and lower surface 38 of body portion 24 of actuator 20 cooperate to define a first flow chamber 176 therebetween. First flow chamber 176 permits communication between first resilient seal 16 and curved notch 42 of body portion 24. Lower surface 166 of first resilient seal 16 includes a lower rim surface 178 and a lower web surface 180. Lower rim surface 178 is positioned to lie flush with lower surface 156 of first well 98. Lower web surface 180 is recessed relative to lower rim surface 178. Rim and web regions 160, 162 each have a constant thickness. The thickness of rim region 160 is greater than the thickness of web region 162.

Second resilient seal 18 is structurally similar to first resilient seal 16 so that like reference numbers refer to like structures as shown in FIG. 5. Inner portion 170 of second resilient seal 18 defines projection-receiving aperture 172 of second resilient seal 18. Second projection 30 nests within projection-receiving aperture 172 of second resilient seal. The diameter of outer surface 62 of wall 60 of second projection 30 is slightly greater than the diameter of projection-receiving aperture 172 when nothing is positioned in projection-receiving aperture 172 so that second projection 30 couples to inner portion 170 of second resilient seal 18 to form a flow-tight seal therewith when actuator 20 is closed. Upper surface 164 of second resilient seal 18 is generally flat and is positioned to lie flush with upper surface 154 of second well 100 so that upper surfaces 154 and 164, second concave walls 108, 129, and 138, and lower surface 38 of body portion 24 of actuator 20 cooperate to define a second flow chamber therebetween 182. Second flow chamber 182 permits communication between second resilient seal 18 and curved notch 44 of body portion 24. Lower rim surface 178 is positioned to lie flush with lower surface 156 of second well 100.

The centers of projection-receiving apertures 172 are positioned to lie a distance X perpendicularly away from plate diametrical axis 112, as shown in FIG. 4, so that each projection 28, 30 aligns with respective projection-receiving aperture 172 when the actuator is closed.

Co-injection molding is, illustratively, used to couple each resilient seal 16, 18 to inner edge 148 of respective well 98, 100 so that chemical and heat bonds exist between each resilient seal 16, 18 and respective inner edge 148.

First well 98, second well 100, and second outer plateau 96 cooperate to define an arcuately-shaped narrow first trench 150 that interconnects both seal-receiving apertures 142 as shown in FIG. 4. Trench 150 permits the use of only one injection port to introduce the elastomeric material of resilient seals 16, 18 during manufacture. Trench 150 may also remain filled with elastomeric material after manufacture.

First well 98 and first outer plateau 94 cooperate to define a small, narrow second trench 151 as shown in FIG. 4. Similarly, second well 100 and outer plateau 94 cooperate to define a small, narrow third trench 152. Second and third trenches 151, 152 provide an escape hatch for gases from the elastomeric material during manufacture. Some elastomeric material may remain in second and third trenches 151, 152 after manufacture.

Figure 8:
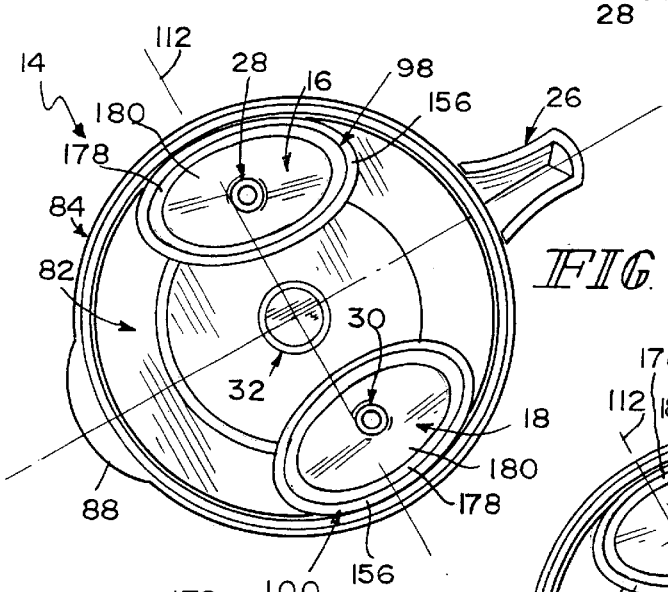
FIG. 8 is a bottom view of the lid of FIG. 2 showing the lid in a normally closed position, each resilient seal embracing the respective projection therearound so that fluid is blocked from passing through either resilient seal.
Figure 9:
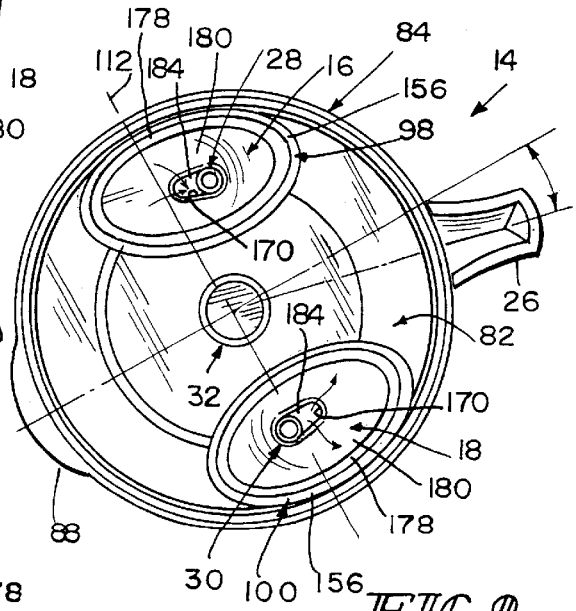
FIG. 9 is a bottom view similar to FIG. 8 showing the lid in an opened position, the actuator having been rotated clockwise relative to the base so that each projection presses against a portion of the respective resilient seal away from an opposite portion of the respective resilient to form a flow passage between each projection and the respective resilient seal.
Figure 10:
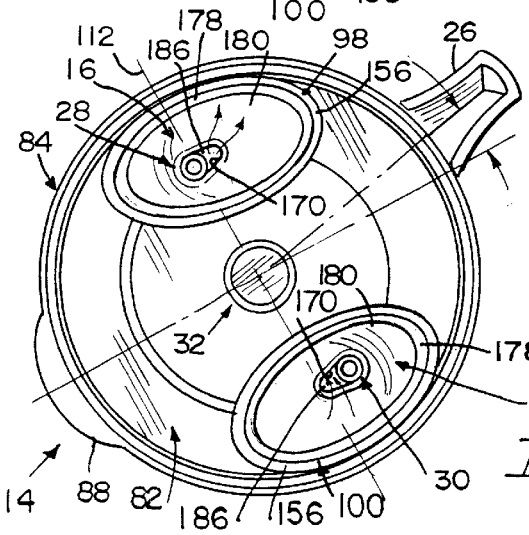
FIG. 10 is a bottom view similar to FIG. 9 showing the lid in an opened position, the actuator having been rotated counter-clockwise relative to the base so that each projection presses against a portion of the respective resilient seal away from an opposite portion of the respective resilient to form a flow passage therebetween.

In operation, actuator 20 is rotatable relative to base 22 between the closed, or no-flow, position, as shown in FIG. 8, to the opened, or flow, position, as shown in FIGS. 9–10.

When actuator 20 is in the closed position as shown in FIG. 8, each projection 16, 18 is positioned to lie within respective projection-receiving aperture 172 and inner portion 170 of each resilient seal 16, 18 embraces outer surface 62 of wall 60 of respective projection 16, 18 so that each inner portion 170 adjoins respective outer surface 62 therearound to form a substantially flow-tight seal therewith. (The term "adjoin" in this specification means that the subject structures physically contact each other.) In the closed position, plate diametrical axis 112 is positioned to lie directly below actuator diametrical axis 46 so that plate diametrical axis 112 and actuator diametrical axis 46 form a vertical plane therewith. Furthermore, each resilient seal 16, 18 is positioned to lie horizontally and each projection-receiving aperture 172 is positioned to lie in concentric relation to outer portion 168 of respective resilient seal 16, 18 and to respective well 98, 100.

To dispense fluid from receptacle 12, a user applies a sufficient actuating force to lever 26 to turn lever 26 clockwise, for example, relative to base 22 to rotate actuator 20 from the closed position to the opened position, as shown in FIG. 9. Movement of actuator 20 relative to base 22 accordingly moves projections 28, 30 relative to resilient seals 16, 18 and moves projections 28, 30 arcuately relative to central axis 110. This movement causes outer surface 62 of wall 60 of each projection 16, 18 to deform inner portion 170 of respective resilient seal 16, 18 by stretching inner portion 170 of respective resilient seal 16, 18 to enlarge respective projection-receiving aperture 172 relative to the size of respective projection-receiving aperture 172 in the closed position. More particularly, a portion of outer surface 62 of each projection 28, 30 presses against and moves a portion of inner portion 170 of respective resilient seal away from an opposite portion of inner portion 170 of respective resilient seal, as shown in FIG. 6 with respect to first resilient seal 16 and first projection 28. At the same time, a portion of web 162 of respective resilient 16, 18 deforms by wrapping partially around outer surface 62 of respective projection 28, 30. If respective projection 28, 30 is moved far enough, one side of web 162 may fold back on itself An opposite portion of outer surface 62 of each projection 28, 30 that is not contacting inner portion 170 of respective resilient seal 16, 18 and an opposite portion of respective inner portion 170 cooperate to define a flow passage 184 therebetween in the opened position.

Flow passages 184 formed in the opened position permit fluid and air to flow through resilient seals 16, 18 when the user simply tilts container 10. In particular, when the user turns lever 26 clockwise, flow passage 184 formed between first resilient seal 16 and first projection 28 permits fluid from the interior region of receptacle 12 to flow through first resilient seal 16 and to first flow chamber 176 so that fluid can flow to curved notch 42 and ultimately to the exterior region of receptacle 12 for consumption by the user—i.e., flow passage 184 formed between first resilient seal 16 and first projection 28 functions as the dispensing flow passage.

At the same time, ambient air flows from curved notch 44 through second flow chamber 182 at which point flow passage 184 formed between second resilient seal 18 and second projection 30 permits ambient air to pass through second resilient seal 18 to the interior region of receptacle 12 so that a "vacuum" condition does not develop within the interior region of receptacle 12—i.e., flow passage 184 formed second resilient seal 18 and second projection 30 functions as the venting flow passage. The user can vary the size of flow passages 184 by the amount of force the user applies to lever 26 to control the amount of fluid dispensed per unit time.

Flow passage 184 formed between first resilient seal 16 and first projection 28 aligns with the center of curved notch 42 as the dispensing flow passage when lever 26 is rotated clockwise to the opened position. More precisely, flow passage 184 formed between first resilient seal 16 and first projection 28 aligns directly below actuator diametrical axis 46 when curved notch 42 and actuator diametrical axis 46 are rotated clockwise to the opened position due to the diametrically offset positioning of first projection 28, first resilient seal 16, and projection-receiving aperture 172 of first resilient seal 16. As a result, the center of curved notch 42 aligns with flow passage 184 formed between first resilient seal 16 and first projection 28 to provide a direct flow path from flow passage 184 formed between first resilient seal 16 and first projection 28 to curved notch 42 to aid in dispensing fluid from receptacle 12 for user consumption.

Flow passage 184 formed between second resilient seal 18 and second projection 30, on the other hand, does not experience such alignment with the center of curved notch 44 as the venting flow passage when lever 26 is rotated clockwise to the opened position. Instead, the center of curved notch 44 moves away from flow passage 184 formed between second resilient seal 18 and second projection 30 when lever 26 is rotated clockwise to the opened position.

When the user removes the actuating force from lever 26, resilient seals 16, 18 automatically urge projections 28, 30 back to the closed position. Moreover, resilient seals 16, 18 provide the sole spring return force to urge projections 28, 30 in this manner. Furthermore, because resilient seals 16, 18 are made of an elastomeric material, resilient seals 16, 18 continuously bias actuator 20 toward the closed position by resisting rotation of projections 28, 30 relative to base 22 and urging projections 28, 30 back toward the closed position from the opened position upon release of lever 26 by the user. For example, after a user is finished "sipping" or dispensing an amount of liquid or other material from container 10, the user releases lever 26 and resilient seals 16, 18 automatically move actuator 20 to the closed position. Furthermore, if container 10 is dropped while in the opened position, resilient seals 16, 18 will move actuator 20 to the closed position preventing fluid from spilling from container 10 as a result of the fall.

Lid 14 operates in a similar fashion when a user rotates actuator 20 in a counter-clockwise direction relative to base 22, as shown in FIG. 10. Rotating actuator 20 counter-clockwise causes outer surfaces 62 of walls 60 of projections 28, 30 to similarly deform resilient seals 16, 18 by pressing against inner portions 170 of resilient seals 16, 18 to stretch inner portions 170 to enlarge projection-receiving apertures 172 to form flow passages 186 between outer surfaces 62 of walls 60 of projections 28, 30 and inner portions 170 of resilient seals 16, 18. Flow passages 186 are formed, however, between the portions of projections 28, 30 and resilient seals 16, 18 opposite from that encountered in the clockwise rotation scenario. As a result, first projection 28 and first resilient seal 16 cooperate to form the venting flow passage while second projection 30 and second resilient seal 18 cooperate to form the dispensing flow passage. Accordingly, the center of curved notch 44 aligns with flow passage 186 formed between second resilient seal 18 and second projection 30 to provide a direct flow path from flow passage 186 formed between second resilient seal 18 and second projection 30 to curved notch 44 to aid in dispensing fluid from receptacle 12 for user consumption similar to that previously discussed. When the user removes the actuating force from lever 26, resilient seals 16, 18 urge projections 28, 30 back to the closed position.

Thus, actuator 20 may be turned in either the clockwise or counter-clockwise directions to provide fluid to the user. This permits ease of use of container 10 by right- and left-handed users.

Figure 11:
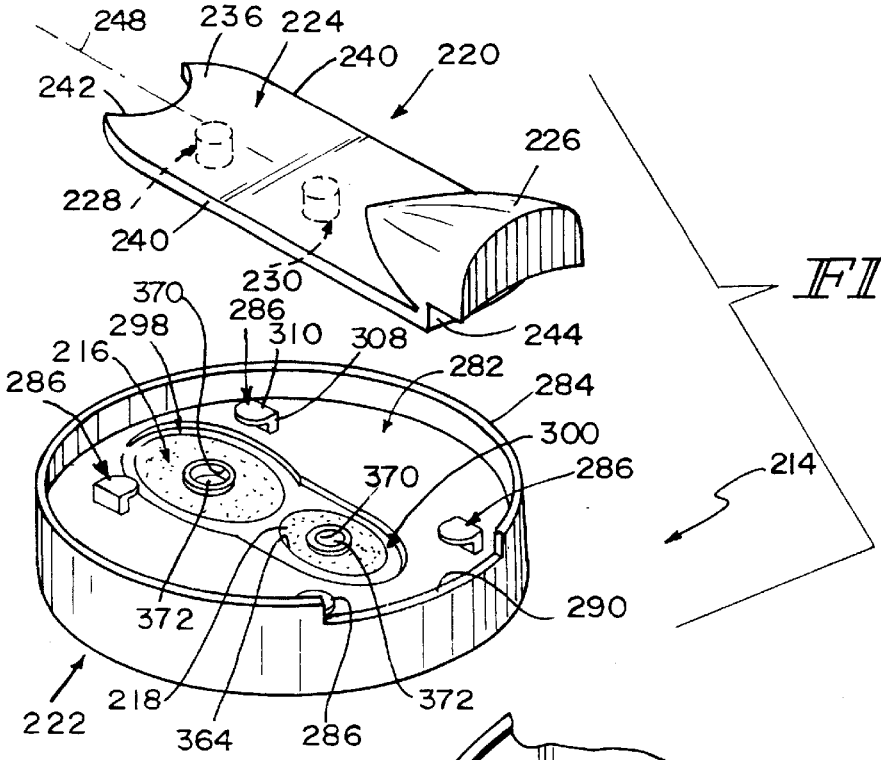
FIG. 11 is a perspective exploded view of an alternative embodiment of the lid showing the lid including a "push-action" actuator, a base, and a pair of elliptical resilient seals, the actuator including a body portion, a lever, and a pair of projections (shown in phantom) that align with a pair of projection-receiving apertures formed within the resilient seals.

In an alternative embodiment of the present invention, a container 210 includes a receptacle 212 and a lid 214. Lid 214 includes first and second resilient seals 216, 218, a rigid "push-action" actuator (or actuation means) 220, and a rigid base 220, as shown in FIG. 11. Actuator 220 is slidably coupled to base 222 for movement relative to base. As previously discussed, actuator 220, base 222, and resilient seals 216, 218 are made of the same materials as in the prior embodiments and are also manufactured by a co-injection molding process. Resilient seals 216, 218 similarly couple to base 222 by chemical and heat bonds and possess the qualities as previously discussed.

Actuator 220 integrally includes a generally rectangular body portion 224, a lever 226, a first projection 228, and a second projection 230.

Body portion 224 includes a flat upper surface 236, a flat lower surface 238, a pair of longitudinally extending side portions 240, a curved lateral edge 242, and an opposite lateral edge 244. Curved lateral edge 242 extends between side portions 240.

Body portion 224 includes a flat upper surface 236, a flat lower surface 238, a pair of longitudinal edges 240, curved lateral edge 242 and opposite lateral edge 244. Curved lateral edge 242 and opposite lateral edge 244 extend between longitudinal edges 240. Longitudinal edges 240 are positioned to lie in spaced-apart parallel relation to an axis 248 extending longitudinally through the middle of body portion 224 between lateral edged 242, 244 (hereinafter referred to as middle longitudinal axis 248). The curvature of curved lateral edge 242 is designed to limit the distance that fluid egressing from container 210 must travel under body portion 224. It is to be understood that variations of the shape of curved lateral edge are within the scope of the present invention.

Lever 226 is coupled to upper surface of body portion 224. Lever 226 slopes upwardly from near the middle of body portion toward opposite lateral edge 244 of body portion 224. Lever 226 receives an actuating force from user sufficient to move body portion 224 along middle longitudinal axis 248 relative to base.

Figure 13:
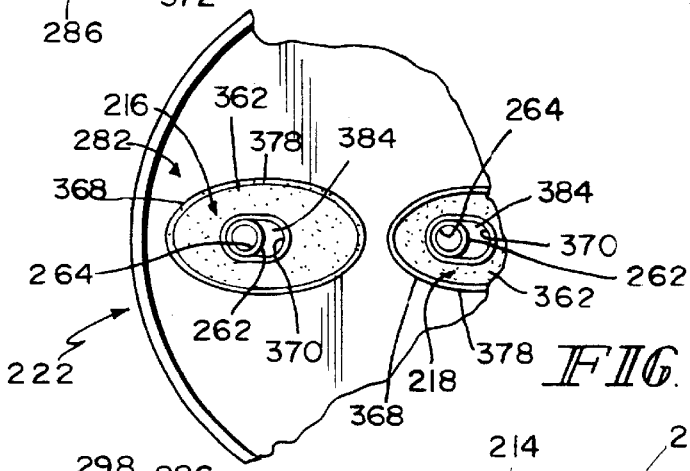
FIG. 13 is a bottom view of the lid of FIG. 11, with portions taken away, showing the lid in the opened position so that so that each projection presses against a portion of the respective resilient seal away from an opposite portion of the respective resilient to form a flow passage therebetween.
Figure 12:
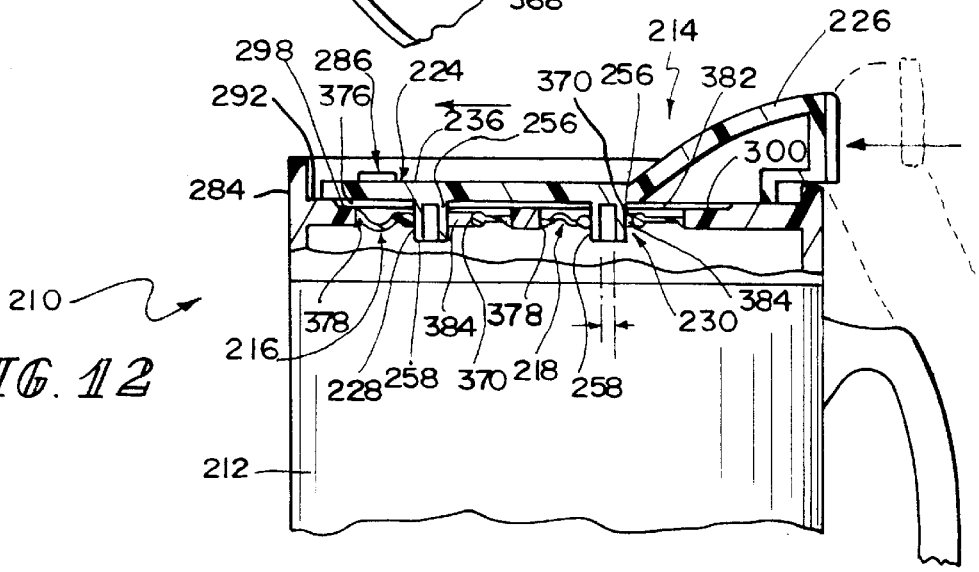
FIG. 12 is a sectional view of the lid of FIG. 11 showing the lid in the opened position so that so that each projection presses a portion of the respective resilient seal away from an opposite portion of the respective resilient to form a flow passage therebetween.

Projections 228, 230 are structurally similar to the projections of the prior embodiment. Projections 228, 230 each include a proximal end 256, a distal end 258, and a wall 260 extending between proximal and distal ends 256, 258, as shown in FIG. 12. Proximal ends 256 are coupled to lower surface 238 of body portion 224. Walls 260 are cylindrically-shaped so that the cross-sections of projections 228, 230 are circular. Each wall 260 includes an outer surface 262 and an inner surface 264, as shown in FIG. 13.

Projections 228, 230 are positioned to lie in spaced-apart relation to each other along middle longitudinal axis 248 of body portion 224. First projection 228 is positioned to lie adjacent to curved lateral edge 242 of body portion 224 at a forward position whereas second projection 230 is positioned to lie at a rearward position.

Base 222 integrally includes a horizontal circular plate 282 extending across the opening of receptacle 212, a rim 284 coupled to the perimeter of plate 282, and four upstanding guide tabs 286 coupled to plate 282, as shown in FIG. 11. Rim 284 is conventional in design and couples base 222 to receptacle 212 in a conventional manner. Rim 284 includes a U-shaped notch 290 in which actuator 220 fits.

Plate 282 is positioned below actuator 220 and includes a plateau 292 region, and first and second elliptically-shaped wells 298, 300 that are structurally similar to the wells of the prior embodiment so that like reference numbers refer to like structures. Each of first and second wells 298, 300 is formed to include an elliptically-shaped inner edge 348. Inner edges 348 each defines an elliptically-shaped seal-receiving aperture 342. Plateau 292 region provides a sliding bearing surface for longitudinal edge 240 of body portion 224. First and second wells 298, 300 are positioned to lie lower than plateau 292 region. Seal-receiving apertures 342 are positioned to lie longitudinally along an axis that lies directly below middle longitudinal axis 248 of body portion 224. Each of inner edges 348 includes a tongue 358 that extends around inner edge 348 and provides additional surface area to which resilient seals 216, 218 bond.

Guide tabs 286 are configured to mesh with longitudinal edges 240 of body portion 224 of actuator 220 to limit body portion 224 to back and forth movement along middle longitudinal axis 248 relative to base 222. Guide tabs 286 are positioned to lie in spaced-apart relation to each other and are coupled to plateau region 292 of plate 282. Specifically, two guide tabs 286 are positioned to lie on either side of body portion 224 of actuator 220 near the four corners of body portion 224 but sufficiently away from the four corners so that longitudinal edges 240 of body portion 224 do not decouple from guide tabs 286 during movement of body portion 224. Guide tabs 286 are generally L-shaped. Each includes a first arm 308 and a second arm 310. First arm 308 is coupled to and extends upwardly from plateau region 292. Second arm 310 is fixedly coupled to and positioned to lie in perpendicular relation to first arm 308 so that second arm 310 extends toward body portion 224 from first arm 308.

First and second resilient seals 216, 218 are structurally similar to the resilient seals of the prior embodiment so that like reference numbers refer to like structures as shown in FIGS. 11–13. First and second resilient seals 216, 218 nest within respective seal-receiving aperture 342 and couple to respective inner edge 348 of respective well 298, 300.

First resilient seal 216 accordingly includes inner portion 370 that defines projection-receiving aperture 372. First projection 228 nests within projection-receiving aperture 372 of first resilient seal 216. The diameter of outer surface 262 of wall 260 of first projection 228 is slightly greater than the diameter of projection-receiving aperture 372 when nothing is positioned in projection-receiving aperture 372 so that first projection 228 couples to inner portion 370 of first resilient seal 216 to form a flow-tight seal therewith when actuator 220 is closed. Upper surface 364 of first resilient seal 216 is generally flat and is positioned to lie flush with first well 298. Upper surface 364 of first resilient seal 216 and lower surface 238 of body portion 224 of actuator 220 cooperate to define a first flow chamber 376 therebetween. Second flow chamber 376 permits communication between first resilient seal 216 and curved lateral edge 242 of body portion 224. Lower rim surface 378 of first resilient seal 216 is positioned to lie flush with first well 298.

Second resilient seal 218 accordingly includes inner portion 370 that defines projection-receiving aperture 372. Second projection 230 nests within projection-receiving aperture 372 of second resilient seal 218. The diameter of outer surface 262 of wall 260 of second projection 230 is slightly greater than the diameter of projection-receiving aperture 372 when nothing is positioned in projection-receiving aperture 372 so that second projection 230 couples to inner portion 370 of second resilient seal 218 to form a flow-tight seal therewith when actuator 220 is closed. Upper surface 364 of second resilient seal 218 is generally flat and is positioned to lie flush with second well 300. Upper surface 364 of second resilient seal 218 and lower surface 238 of body portion 224 of actuator 220 cooperate to define a second flow chamber 382 therebetween. Second flow chamber 382 permits communication between second resilient seal 218 and opposite lateral edge 244 of body portion 240. Lower rim surface 378 of second resilient seal 218 is positioned to lie flush with second well 300.

Actuator 220 is coupled to base 222 by vertically aligning first and second projections 228, 230 with projection-receiving apertures 372, respectively, placing longitudinal edges 240 on the tops of second arms 310 of guide tabs 286, and pressing down on upper surface 236 of body portion 224 so that longitudinal edges 240 squeeze past second arms 310 to mesh with first and second arms 308, 310 of guide tabs 286 for longitudinal movement of body portion 224 along middle longitudinal axis 248 relative to base 222.

In operation, actuator 220 is moveable back and forth relative to base 222 along middle longitudinal axis 248 of body portion 224 between the closed, or no-flow, position and the opened, or flow, position relative to base 222, as shown in FIGS. 12–13.

When actuator 220 is in the closed position, each projection 216, 218 is positioned to lie within respective projection-receiving aperture 372 and inner portion 370 of each resilient seal 216, 218 embraces respective outer surface 262 of wall 260 of respective projection 228, 230 SO that each inner portion 370 adjoins outer surface 262 therearound to form a substantially flow-tight seal therewith. Furthermore, each resilient seal 216, 218 is positioned to lie horizontally and each projection-receiving aperture 372 is positioned to lie in concentric relation to outer portion 368 of respective resilient seal 216, 218 and respective well 298, 300.

To dispense fluid from receptacle 212, a user applies a sufficient actuating force to lever 226 to push lever 226 forward toward curved lateral edge 242 of body portion 224 to move actuator 220 from the closed position to the opened position. Movement of actuator 220 relative to base 222 accordingly moves projections 228, 230 relative to resilient seals 216, 218. This movement causes outer surface 262 of wall 260 of each projection 228, 230 to deform inner portion 370 of respective resilient seal 216, 218 by stretching inner portion 370 of respective resilient seal 216, 218 to enlarge respective projection-receiving aperture 372 relative to the size of projection-receiving aperture 372 in the closed position. More particularly, a portion of outer surface 262 of each projection 228, 230 presses against and moves a portion of inner portion 370 of respective resilient seal 216, 218 away from an opposite portion of inner portion 370 of respective resilient seal 216, 218. At the same time, a portion of each web 362 of respective resilient seal 216, 218 deforms by wrapping partially around outer surface 262 of respective projection 228, 230. If respective projection 228, 230 is moved far enough, one side of each web 362 of respective resilient seal 216, 218 may fold back on itself. An opposite portion of outer surface 262 of each projection 228, 230 that is not contacting inner portion 370 of respective resilient seal 216, 218 and an opposite portion of respective inner portion 370 cooperate to define a flow passage 384 therebetween. Each flow 384 passage aligns directly below middle longitudinal axis 248 of body portion 224 in the opened position.

Flow passages 384 formed in the opened position permit fluid and air to flow through resilient seals 216, 218 when the user simply tilts container 210. Flow passage 384 formed between first resilient seal 216 and first projection 228 functions as the dispensing flow passage while flow passage 384 formed between second resilient seal 218 and second projection 230 functions as the venting flow passage. In particular, when the user pushes lever 226 to the opened position, flow passage 384 formed between first resilient seal 216 and first projection 228 permits fluid from the interior region of receptacle 212 to flow through first resilient seal 216. Egressing fluid then flows through first flow chamber 376 and around first projection 228, passed curved lateral edge 242 of body portion 224, and ultimately to the exterior of receptacle 212 for consumption by the user. At the same time, ambient air from the exterior of receptacle 212 passes through second flow chamber 382 at which point flow passage 384 formed between second resilient seal 218 and second projection 230 permits ambient air to pass through second resilient seal 218 into the interior region of receptacle 212 to prevent a "vacuum" condition from developing within the interior region of receptacle 212. As in the prior embodiment, the user can vary the size of flow passages 384 by the amount of force the user applies to lever 226 to control the amount of fluid dispensed per unit time.

When the user removes the actuating force from lever 226, resilient seals 216, 218 alone urge projections 228, 230 back to the closed position. Furthermore, resilient seals 216, 218 continuously bias actuator 220 toward the closed position as previously discussed.

Figure 14:
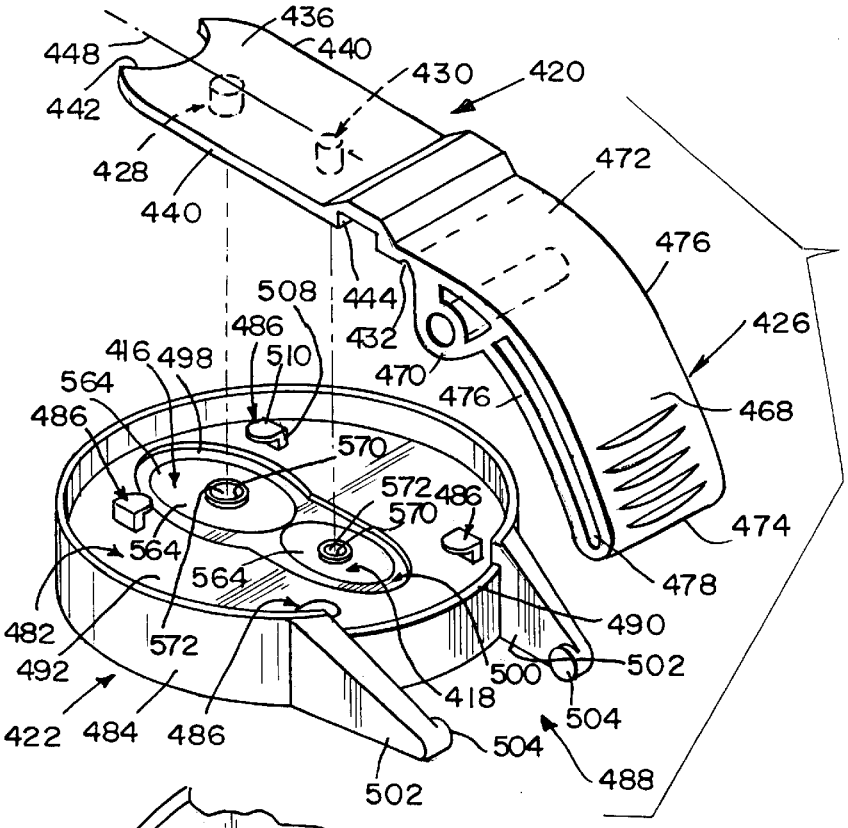
FIG. 14 is a perspective exploded view of an alternative embodiment of the lid showing the lid including a "pull-action" actuator, a base, and a pair of elliptical resilient seals, the actuator including a body portion, a lever, and a pair of projections (shown in phantom) that align with a pair of projection-receiving apertures formed with the resilient seals.

In another alternative embodiment of the present invention, a container 410 includes a receptacle 412 and a lid 414. Lid 414 includes a first resilient seal 416, a second resilient seal 418, a "pull-action" actuator (or actuation means) 420, and a rigid base 422, as shown in FIG. 14. This embodiment of lid 414 may be used, illustratively, with a decanter as container 410, which typically calls for dispensing a higher volume of fluid per second than ordinary drinkware. Actuator 420 is slidably coupled to base 422 for movement relative to base 422. As previously discussed, actuator 420, base 422, and resilient seals 416, 418 are made of the same materials as in the prior embodiments and are also manufactured by a co-injection molding process. Resilient seals 416, 418 similarly couple to base 422 by chemical and heat bonds and possess the qualities previously discussed.

Actuator 420 integrally includes a horizontal, rigid, generally rectangular body portion 424, a rigid lever 426, rigid first and second projection 428, 430, and a thin hinge portion 432, as shown in FIG. 14.

Body portion 424 is structurally similar to body portion 224 of the "push-action" embodiment of the present invention so that body portion 424 includes a flat upper surface 436, a flat lower surface 438, a pair of longitudinal edges 440, curved lateral edge 442 and opposite lateral edge 444. Curved lateral edge 442 and opposite lateral edge 444 extend between longitudinal edges 440. Longitudinal edges 440 are positioned to lie in spaced-apart parallel relation to an axis 448 extending longitudinally through the middle of body portion 424 (hereinafter referred to as middle longitudinal axis 448).

Figure 16:
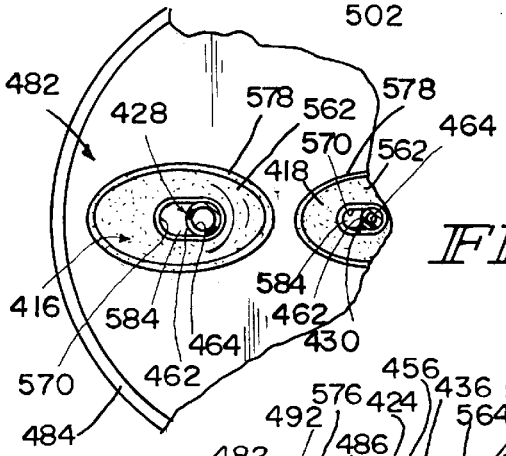
FIG. 16 is a bottom view of the lid of FIG. 14, with portions taken away, showing the lid in the opened position so that so that each projection presses against a portion of the respective resilient seal away from an opposite portion of the respective resilient to form a flow passage therebetween.
Figure 15:
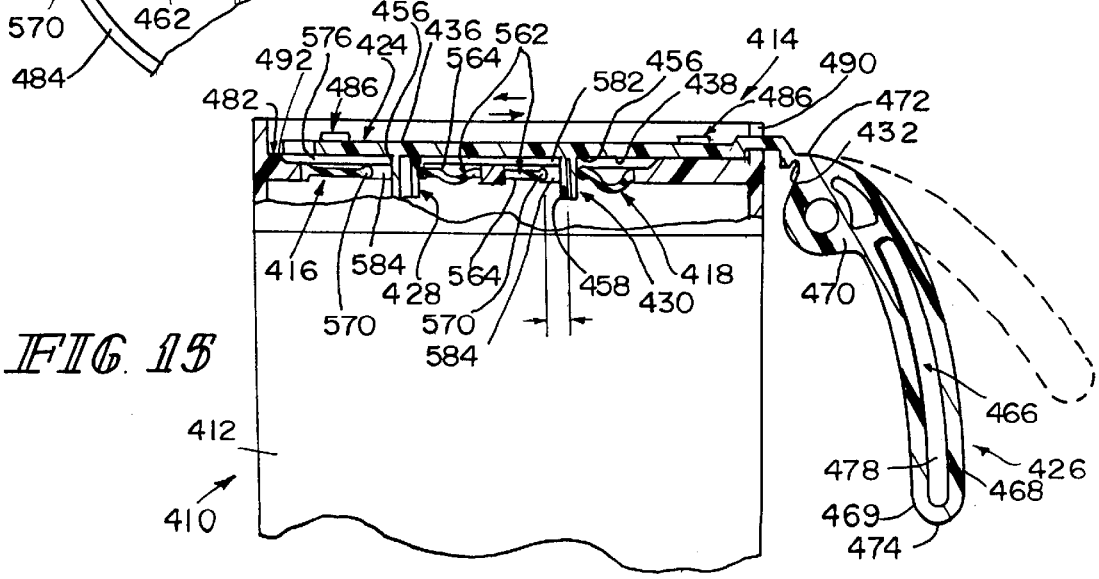
FIG. 15 is a sectional view of the lid of FIG. 14 showing the lid in the opened position so that so that each projection presses a portion of the respective resilient seal away from an opposite portion of the respective resilient to form a flow passage therebetween.

Projections 428, 430 are structurally similar to that previously discussed except that first projection 428 is larger than second projection 430 because lid may be used with a decanter, for example, which typically calls for a higher volumetric flow rate than ordinary drinkware as previously mentioned. Projections 428, 430 each include a proximal end 456, a distal end 458, and a wall 460 extending between proximal and distal ends 456, 458, as shown in FIG. 15. Proximal ends 456 are coupled to lower surface 424 of body portion 424. Walls 460 are cylindrically-shaped so that the cross-sections of projections 428, 430 are circular. Each wall 460 includes an outer surface 462 and an inner surface 464 as shown in FIG. 16.

Projections 428, 430 are positioned to lie in spaced-apart relation to each other along middle longitudinal axis 448 of body portion 424. First projection 428 is positioned to lie adjacent to curved lateral edge 442 at a forward position whereas second projection 430 is positioned to lie at a rearward position.

Lever 426 includes a curved arm 466, an upper surface 468, a lower surface 469, and a pivot ring 470, as shown in FIG. 14. Curved arm 466 includes a proximal end 472, a distal end 474 and a pair of longitudinal edges 476. Curved arm 466 slopes downwardly away from proximal end 472 to distal end 474. Curved arm 466 includes a cored portion 478. Pivot ring 470 is cylindrically-shaped having an annular cross-section and extends between longitudinal edges 476. Pivot ring 470 is coupled to lower surface 469 of curved arm 466 near proximal end 472 and is pivotally coupled to base 422. Upper surface 468 of lever 426 receives an actuating force from user sufficient to move body portion 424 along middle longitudinal axis 448 of body portion 424.

Thin hinge portion 432 couples opposite lateral edge 444 of body portion 424 to proximal end 472 of curved arm 466 of lever 426. The thickness of hinge portion 432 is less than either the thickness of opposite lateral edge 444 of body portion 424 or the thickness of proximal end 472 of curved arm 466 of lever 426 so that curved arm 466 can pivot up and down relative to body portion 424 during movement of body portion 424 along middle longitudinal axis 448 relative to base 422.

Base 422 integrally includes a horizontal, circular plate 482 that extends across the opening of receptacle 412, a rim 484 coupled to the perimeter of plate 482, four upstanding guide tabs 486 coupled. Rim 484 is conventional in design and couples base 422 to receptacle 412 in a conventional manner. Rim 484 includes a U-shaped notch 490 in which actuator 420 fits.

Plate 482 is positioned below actuator 420 and includes a plateau 492 region, and first and second elliptically-shaped wells 498, 500 that are structurally similar to the wells of the prior embodiments so that like reference numbers refer to like structures. Each of first and second wells 498, 500 is formed to include an elliptically-shaped inner edge 548. Inner edges 548 each defines an elliptically-shaped seal-receiving aperture 542. Plateau region 492 provides a sliding bearing surface for longitudinal edges 440 of body portion 424. First and second wells 498, 500 are positioned to lie lower than plateau 492 region. Seal-receiving apertures 542 are positioned to lie longitudinally along an axis that lies directly below middle longitudinal axis 448 of body portion 424. Each of inner edges 548 includes a tongue 558 that extends around inner edge 548 and provides additional surface area to which resilient seals 416, 418 bond.

Guide tabs 486 are configured to mesh with longitudinal edges 440 of body portion 424 of actuator 420 to limit body portion 424 to back and forth movement along middle longitudinal axis 448 relative to base 422. Guide tabs 486 are positioned to lie in spaced-apart relation to each other and are coupled to plateau region 492 of plate 482. Specifically, two guide tabs 486 are positioned to lie on either side of body portion 424 of actuator 420 near the four corners of body portion 424 but sufficiently away from the four corners so that longitudinal edges 440 of body portion 424 do not decouple from guide tabs 486 during movement of body portion 424. Guide tabs 486 are structurally similar to guide tabs 386 of the prior embodiment so that like reference numbers refer to like structures. First arm 508 is fixedly coupled to and extends upwardly from plateau region 492 of plate 482. Second arm 510 is coupled to and positioned to lie in perpendicular relation to first arm 508 so that second arm 510 extends away from first arm 508 to slidably couple to upper surface 436 of body portion 424.

Pivot assembly 488 includes a pair of tapered pivot fins 502 and a pair of pivot pins 504. Pivot fins 502 are coupled to rim 484 and positioned to lie in spaced-apart oppositional relation to each other. Pivot pins 504 each couple to respective pivot fin 502 so that pivot pins 504 are positioned to lie in oppositional relation to each other. Pivot pins 504 couple to pivot ring 470 of lever 426 such that pivot pins 504 are positioned to lie within pivot ring 470. As a result, curved arm 466 of lever 426 can pivot about pivot pins 504 in order to move body portion 424 back and forth along middle longitudinal axis 448 of body portion 424 relative to base 422.

First and second resilient seals 416, 418 are structurally similar to the resilient seals of the prior embodiments so that like reference numbers refer to like structures, as shown in FIGS. 14–16. First and second resilient seals 416, 418 nest within respective seal-receiving aperture 542 and couple to respective inner edge 548 of respective well 498, 500.

First resilient seal 416 accordingly includes inner portion 570 that defines projection-receiving aperture 572. First projection 428 nests within projection-receiving aperture 572 of first resilient seal 416. The diameter of outer surface 462 of wall 460 of first projection 428 is slightly greater than the diameter of projection-receiving aperture 572 when nothing is positioned in projection-receiving aperture 572 so that first projection 428 couples to inner portion 570 of first resilient seal 416 to form a flow-tight seal therewith when actuator 420 is closed. Upper surface 564 of first resilient seal 416 is generally flat and is positioned to lie flush with first well 498. Upper surface 564 of first resilient seal 416 and lower surface 438 of body portion 424 of actuator 420 cooperate to define a first flow chamber 576 therebetween. First flow chamber 576 permits communication between first resilient seal 416 and curved lateral edge 442 of body portion 424. Lower rim surface 578 of first resilient seal 416 is positioned to lie flush with first well 498.

Second resilient seal 418 accordingly includes inner portion 570 that defines projection-receiving aperture 572. Second projection 430 nests within projection-receiving aperture 572 of second resilient seal 418. The diameter of outer surface 462 of wall 460 of second projection 430 is slightly greater than the diameter of projection-receiving aperture 572 when nothing is positioned in projection-receiving aperture 572 so that second projection 430 couples to inner portion 570 of second resilient seal 418 to form a flow-tight seal therewith when actuator 420 is closed. Upper surface 564 of second resilient seal 418 is generally flat and is positioned to lie flush with second well 500. Upper surface 564 of second resilient seal 418 and lower surface 438 of body portion 424 of actuator 420 cooperate to define a second flow chamber 582 therebetween. Second flow chamber 582 permits communication between second resilient seal 418 and opposite lateral edge 444 of body portion 424. Lower rim surface 578 of second resilient seal 418 is positioned to lie flush with second well 500.

In operation, actuator 420 is moveable back and forth relative to base 422 along middle longitudinal axis 448 between a closed, or no-flow, position to an opened, or flow, position, as shown in FIGS. 15–16.

When actuator 420 is in the closed position, each projection 428, 430 is positioned to lie within respective projection-receiving aperture 572 and inner portion 570 of each resilient 416, 418 seal embraces respective outer surface 462 of wall 460 of respective projection 428, 430 so that each inner portion 570 adjoins outer surface 462 therearound to form a substantially flow-tight seal therewith. Furthermore, each resilient seal 416, 418 is positioned to lie horizontally and each projection-receiving aperture 572 is positioned to lie in concentric relation to outer portion 468 of respective resilient seal 416, 418 and respective well 498, 500.

To dispense fluid from receptacle 412, a user applies a sufficient actuating force to curved arm 466 of lever 426 to move actuator 420 from the closed position to the opened position. A user pushes down on curved arm 466 so that body portion 424 is pulled toward the rear of receptacle 412. In so doing, curved arm 466 pivots relative to body portion 424 through hinge 432 and pivots relative to base 422 through pivot assembly 488.

Movement of actuator 420 relative to base 422 accordingly moves projections 428, 430 relative to resilient seal 416, 418 to the opened position. This movement causes outer surface 462 of wall 460 of each projection 428, 430 to deform inner portion 570 of respective resilient seal 416, 418 by stretching inner portion 570 of respective resilient seal 416, 418 to enlarge respective projection-receiving aperture 572 relative to the size of respective projection-receiving aperture 572 in the closed position. More particularly, a portion of outer surface 462 of each projection 428, 430 presses against and moves a portion of inner portion 570 of respective resilient seal 416, 418 away from an opposite portion of inner portion 570 of respective resilient seal 416, 418. At the same time, a portion of web 562 of respective resilient 416, 418 deforms by wrapping partially around outer surface 462 of respective projection 428, 430. If respective projection 428, 430 is moved far enough, one side of respective web 562 may fold back on itself As a result, an opposite portion of outer surface 462 of each projection 428, 430 that is not contacting inner portion 570 of respective resilient seal 428, 430 and an opposite portion of respective inner portion 570 cooperate to define a flow passage 584 therebetween. Each flow passage 584 aligns directly below middle longitudinal axis 548 of body portion 424 in the opened position.

Flow passages 584 formed in the opened position permit fluid and air to flow through resilient seal 416, 418 when the user simply tilts container 410. Flow passage 584 formed between first resilient seal 416 and first projection 428 functions as the dispensing flow passage while flow passage 584 formed between second resilient seal 418 and second projection 430 functions as the venting flow passage. In particular, when the user pushes down on lever 426 to pull body portion 424 rearward to the opened position, flow passage 584 formed between first resilient seal 416 and first projection 430 permits fluid from the interior region of receptacle 412 to flow through first resilient seal 416. Egressing fluid flows through first flow chamber 576 and passed curved lateral edge 442 of body portion 424 and ultimately to the exterior of receptacle 412 for consumption by the user. At the same time, ambient air passes from the exterior of receptacle 412 through second flow chamber 582 at which point flow passage 584 formed between second resilient seal 418 and second projection 430 permits the air to pass through second resilient seal 418 into the interior region of receptacle 412 to prevent a "vacuum" condition from developing within the interior region of receptacle 412. As in the prior embodiments, the user can vary the size of flow passages 584 by the amount of force the user applies to lever 426 to control the amount of fluid dispensed per unit time.

When the user removes the actuating force from lever 426, resilient seals 416, 418 alone urge projections 428, 430 back to the closed position. Furthermore, resilient seals 416, 418 continuously bias actuator 420 toward the closed position as previously discussed.

Figure 17:
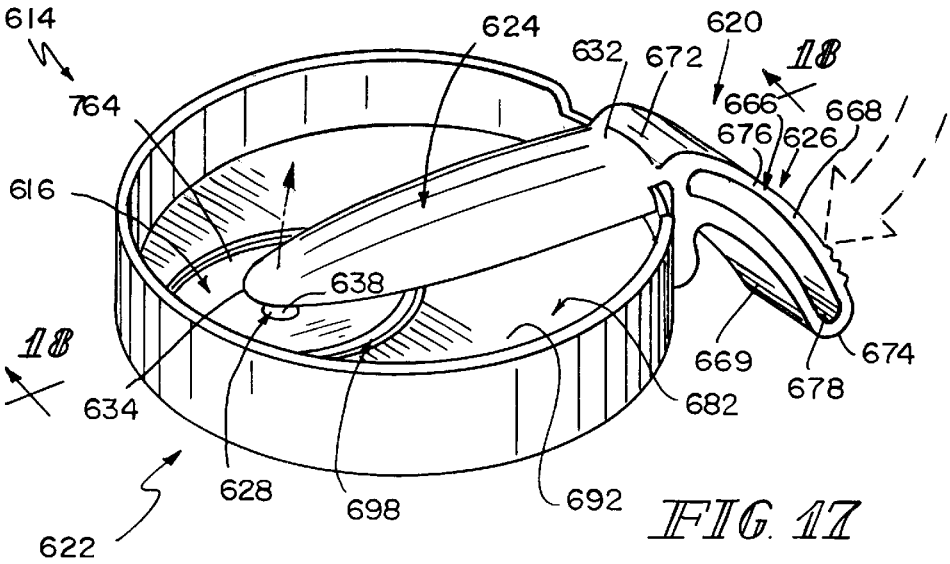
FIG. 17 is a perspective view of another embodiment of the lid showing the lid in the closed position, the lid including a "lift-action" actuator, a base, and an elliptical resilient seal, the actuator including a body portion, a lever, and a projection positioned to lie within a projection-receiving aperture formed within the resilient seal.

In yet another embodiment of the present invention, a container 610 includes a receptacle 612 and a lid 614. Lid 614 includes a resilient seal 616, a rigid "lift-action" actuator 620 (or actuation means), and a rigid base 622, as shown in FIG. 17. Actuator 620 is pivotally coupled to base. As previously discussed, actuator 620, base 622, and resilient seal 616 are made of the same materials as the prior embodiments and are also manufactured by a co-injection molding process. Resilient seal 616 similarly couples to base 622 by chemical and heat bonds and possesses the qualities previously discussed. Although only one resilient seal 616 is described in connection with this embodiment, it is to be understood that more than one resilient seal could be included as in connection with the prior embodiments.

Figure 18:
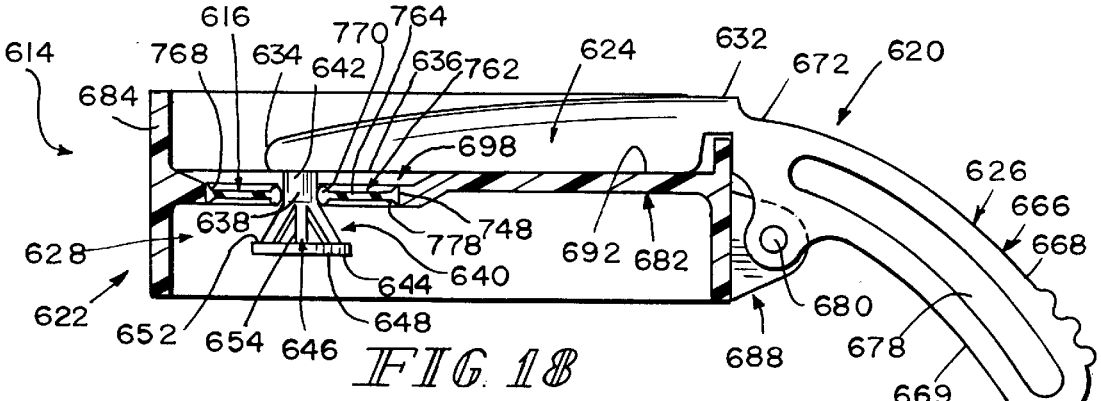
FIG. 18 is a sectional view of the lid taken along the line 18—18 of FIG. 17 showing the lid in the closed position, the projection including a cylindrical plug portion coupled to the body portion and a conical cage portion, the resilient seal embracing the plug portion therearound to prohibit fluid from passing through the resilient seal.

Actuator 620 integrally includes a horizontal, elongated body portion 624, a lever 626, and a projection 628, as shown in FIG. 18. Although only one projection 628 is illustratively described in connection with this embodiment, it is to be understood that this embodiment could include the same number of projection as resilient seal.

Body portion 624 includes a proximal end 632, a distal end 634, and a flat surface 636 extending between proximal and distal ends 632, 634. Body portion 624 tapers in width between proximal and distal ends 632, 634.

Lever 626 is structurally similar to lever 626 in connection with "pull-type" actuator. Lever 626 includes a curved arm 666, an upper surface 668, a lower surface 669, and a pivot ring 670. Curved arm 666 includes a proximal end 672, a distal end 674, and a pair of longitudinal edges 676. Proximal end 672 of curved arm 666 is coupled to proximal end 632 of body portion 624. Curved arm 666 slopes downwardly away from proximal end 672 to distal end 674. Curved arm 666 includes a cored portion 678. Pivot ring 670 is cylindrically-shaped having an annular cross-section and extends between longitudinal edges 676. Pivot ring 670 is coupled to lower surface 669 of curved arm 666 near proximal end 672 and pivotally couples lever 626 to base 622. A pivot axis 680 extends through pivot ring 670. Lever 626 receives an actuating force from user sufficient to pivot body portion 624 about pivot axis 680.

Figure 19:
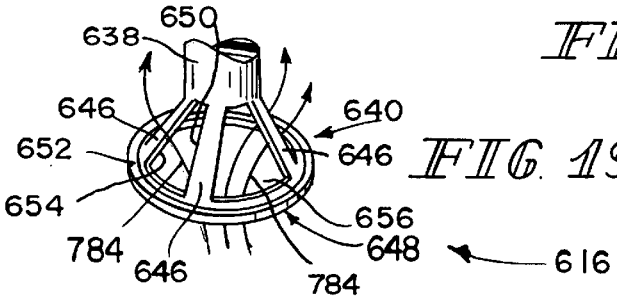
FIG. 19 is an enlarged perspective view of the projection of FIG. 18, the cage portion being formed to include a plurality of fingers and an annular stopper, the plurality of fingers and the stopper being arranged to form a plurality of orifices.

Projection 628 is positioned to lie at distal end 634 of body portion 624 and extends downwardly from flat surface 636 of body portion 624. Projection 628 includes a plug portion 638, a cage portion 640, a proximal end 642, and a distal end 644, as shown in FIG. 19. Proximal end 642 couples to flat surface 636 of body portion 624 at distal end 644 of body portion 624. Plug portion 638 is cylindrically-shaped and extends from proximal end 642 to cage portion 640. Cage portion 640 is conically-shaped and extends from plug portion 638 to distal end 644 so that the diameter of distal end 644 is greater than the diameter of proximal end 642. Plug portion 638 is positioned to lie above cage portion 640. Cage portion 640 includes a plurality of fingers 646 and an annular stopper 648 positioned to lie at distal end 644. Fingers 646 cooperate to define a cavity 650 inside of the "cone" of cage portion 640. Each finger 646 includes an end coupled to plug portion 638 and an opposite end coupled to stopper 648. Stopper 648 extends between and radially outwardly from the opposite ends of fingers 646. Stopper 648 includes a flat abutment surface 652. Fingers 646 and stopper 648 are arranged to form orifices 654 therebetween. Being annularly-shaped, stopper 648 is arranged to form an opening 656 at the bottom of projection 628.

Base 622 integrally includes a horizontal, circular plate 682 that extends across the opening of receptacle 612, a rim 684 coupled to the perimeter of plate 682, and a pivot assembly 688 coupled to rim 684, as shown in FIGS. 17–18. Rim 684 is conventional in design and couples base 622 to receptacle 612 in a conventional manner.

Plate 682 is positioned below body portion 624 and includes a plateau region 692 and an elliptically-shaped well 698. Well 698 is similar in structure to the wells of the prior embodiments so that like reference numbers refer to like structures. Well 698 is formed to include an elliptically-shaped inner edge 748. Inner edge 748 defines an elliptically-shaped seal-receiving aperture 742 and includes a tongue 758 that extends around inner edge 748 and provides additional surface area to which resilient seal 616 bonds. Well 698 is positioned to lie lower than plateau region 692.

Pivot assembly 688 is structurally similar to pivot assembly 488 disclosed in connection with the "pull-action" actuator embodiment so that like reference numbers refer to like structures.

Resilient seal 616 is structurally similar to the resilient seals described in connection with the prior embodiments so that like reference numbers refer to like structures, as shown in FIG. 17–18. Outer portion 768 of resilient seal 616 bonds to inner edge 748 of well 698. Inner portion 770 of web region 762 of resilient seal 616 defines projection-receiving aperture 772. Projection 628 nests within projection-receiving aperture 772 as will be more fully described below. Projection-receiving aperture 772 is positioned to lie in concentric relation to outer portion of resilient seal 616 and well 698 when actuator 620 is closed. Upper surface 764 of first resilient seal 616 is generally flat when actuator 620 is closed and is positioned to lie flush with well 698. Upper surface 764 of resilient seal 616 and flat surface 636 of body portion 624 cooperate to define a flow chamber 776 therebetween. Flow chamber 776 permits communication between resilient seal 616 and distal end 634 of body portion 624. Lower rim surface 778 of resilient seal 616 is positioned to lie flush with well 698.

Figure 20:
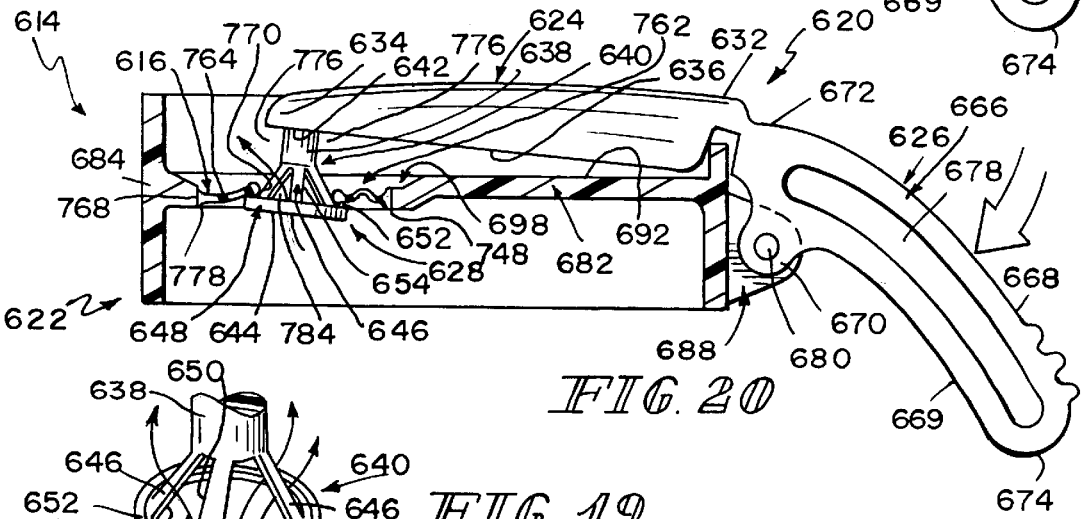
FIG. 20 is a sectional view of the lid of FIG. 18 showing the lid in the opened position, the projection being lifted so that the plurality of fingers of the conical cage portion and the resilient cooperate to define a plurality of flow passages to permit fluid to pass through the resilient seal.

In operation, actuator 620 is pivotally coupled to base 622 for movement between the closed, or no-flow, position, as shown in FIG. 18, to the opened, or flow, position, as shown in FIG. 20. Pivot ring 670 pivotally couples actuator 620 to pivot assembly 688 as described in the "pull-action" actuator embodiment.

When actuator 620 is in the closed position, plug portion 638 of projection 628 is positioned to lie within projection-receiving aperture 772 and inner portion 770 of resilient seal 616 slidably couples to plug portion 638, as shown in FIG. 18. More particularly, inner portion 770 of resilient seal 616 embraces plug portion 638 so that inner portion 770 adjoins plug portion 638 therearound to form a substantially flow-tight seal therewith. The diameter of plug portion 638 is slightly greater than the diameter of projection-receiving aperture 772 when nothing is positioned in projection-receiving aperture 772 so that such a flow-tight seal is obtained when plug portion 638 is positioned in the projection-receiving aperture 772. In the closed position, cage portion 640 of projection 628 is positioned to lie inside of interior region of receptacle 612 below inner portion 770 of resilient seal 616 so that orifices 654 cannot conduct fluid out of receptacle 612. Furthermore, resilient seal 616 is positioned to lie horizontally.

To dispense fluid from receptacle 612, a user applies a sufficient actuating force to curved arm 766 of lever 626 to move actuator 620 from the closed position to the opened position, as shown in FIG. 20. A user pushes down on curved arm 766 so that body portion 624 pivots around pivot axis 680 thereby lifting projection 628 upwardly substantially perpendicularly to the plane of projection-receiving aperture 772. Moving projection 628 in this manner causes plug portion 638 to slide through projection-receiving aperture 772 while inner portion 770 continues to adjoin plug portion 638 therearound. As body portion 624 continues to lift projection 628, cage portion 640 slidably couples to inner portion 770 so that plurality of fingers 646 of cage portion 640 adjoins inner portion 770 to deform inner portion 770. More particularly, due to the conical geometry of cage portion 640, as cage portion 640 is lifted through projection-receiving aperture 772, plurality of fingers 646 gradually stretch inner portion 770 radially outwardly from the center of projection-receiving aperture 772 to enlarge projection-receiving aperture 772 relative to the size of projection-receiving aperture 772 in the closed position until abutment surface 652 of stopper 648 abuts lower surface of resilient seal 616. Abutment surface 652 prevents cage portion 640 from being lifted out of projection-receiving aperture 772 so that projection 628 does not decouple from resilient seal 616. Inner portion 770 reaches its radially outermost position when abutment surface 652 abuts resilient seal 616.

A portion of fingers 646 are positioned to lie outside the interior region of receptacle 612 in flow chamber 776 so that orifices 654 of cage portion 640, or at least a portion thereof, can conduct fluid out of receptacle 612 when the actuator 620 is opened. Inner portion 770 of resilient seal 616 and the portion of fingers 646 spaced-apart from inner portion 770 and outside the interior region of receptacle 612 in flow chamber 776 cooperate to define a plurality of flow passages 784 for fluid to flow therethrough out of receptacle 612 in the opened position.

Figure 21:
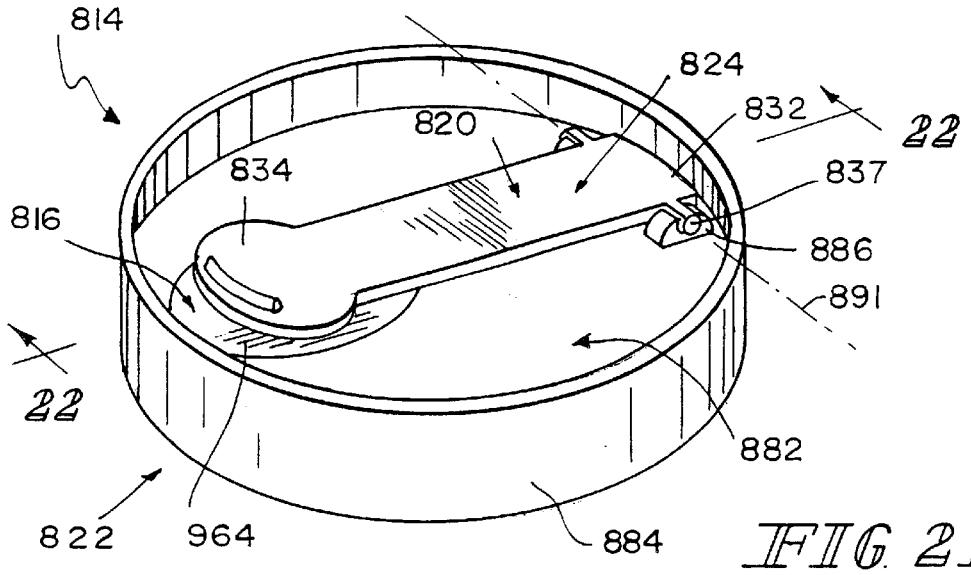
FIG. 21 is a perspective of another embodiment of the lid showing the lid in the closed position, the lid including a "push-down-action" actuator, a base, and an elliptical resilient seal, the actuator including a body portion and a projection positioned to lie within a projection-receiving aperture formed within the resilient seal.
Figure 22:
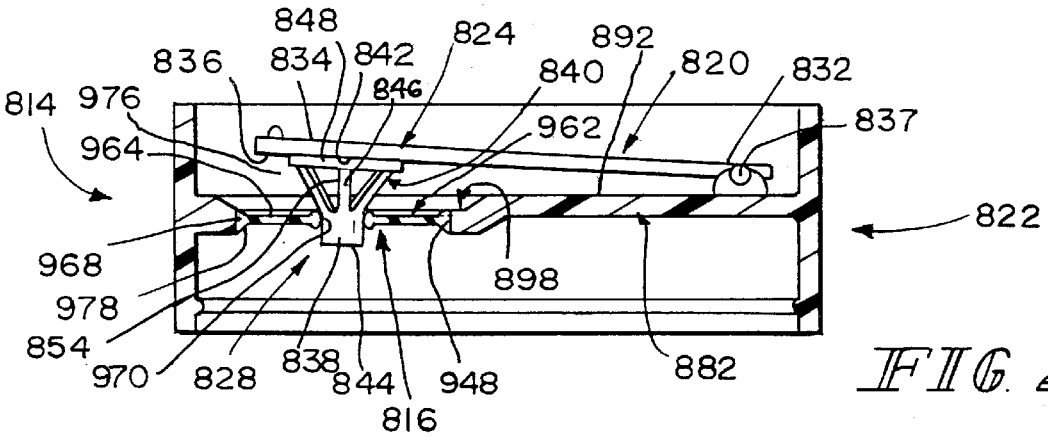
FIG. 22 is a sectional view of the lid taken along the line 22—22 of FIG. 21 showing the lid in the closed position, the projection including a cylindrical plug portion and a conical cage portion coupled to the body portion, the cage portion being formed to include a plurality of fingers, the plurality of fingers being arranged to form a plurality of orifices, the resilient seal embracing the plug portion therearound to prohibit fluid from passing through the resilient seal.

In the opened position, fluid can egress from receptacle 612 when the user simply tilts container 710. Fluid passes through resilient seal 616 by flowing through opening 656 of projection 628 into cavity 650 of cage portion 640 and through flow passages 784 into flow chamber 776 so the fluid can then flow to the exterior region of receptacle 612 for user consumption, as shown in FIGS. 21–22. At the same time, flow passages permit ambient air to flow from flow chamber 776 through resilient seal 616 into the interior region of receptacle 612 to minimize any incipient "vacuum" condition that may develop. Similar to the prior embodiments, the user can vary the size of flow passages 784 by the amount of force the user applies to lever 626 to control the amount of fluid dispensed per unit time.

When the user removes the actuating force from lever 626, resilient seal 616 urges projection 628 back to the closed position. Resilient seal 616 provides the sole spring return force to move projection 628 back to the closed position while the conical geometry of cage portion 640 provides the unstable condition that occasions the spring return of resilient seal 616. More particularly, when the actuating force is removed, inner portion 770 of resilient seal 616 slidably couples to plurality of fingers 646 to squeeze cage portion 640 back into the interior region of receptacle 612 so that plug portion 638 reenters projection-receiving aperture 772 and inner portion 770 again adjoins plug portion 638 therearound to form a flow-tight seal therewith to prohibit fluid from passing through the projection-receiving aperture 772. Furthermore, resilient seal 616 continuously biases actuator 620 toward the closed position as a result of the resilient nature of the elastomeric material of resilient seal 616 and the conical geometry of cage portion 640.

As projection 628 slides back and forth against inner portion 770 of resilient seal 616 between the closed and opened positions, inner portion 770 wipes projection 628. This wiping effect aids in removing substances, such as granulated particles, pellets, and powdered materials, for example, from between projection 628 and inner portion 770 of resilient seal 616 that could adversely affect the desired seal between projection 628 and inner portion 770.

In yet another embodiment of the present invention, a container 810 includes a receptacle 812 and a lid 814. Lid 814 includes a resilient seal 816, a rigid "push-down-action" actuator 820 (or actuation means), and a rigid base 822, as shown in FIG. 21. Actuator 820 is pivotally coupled to base 822. As previously discussed, actuator 820, base 822, and resilient seal 816 are made of the same materials as the prior embodiments and are also manufactured by a co-injection molding process. Resilient seal 816 similarly couples to base 822 by chemical and heat bonds and possesses the qualities as previously discussed. Although only one resilient seal is described in connection with this embodiment, it is to be understood that more than one resilient seal could be included as with prior embodiments.

Actuator 820 integrally includes a horizontal, elongated body portion 824 and a projection 828, as shown in FIG. 22. Although only one projection is illustratively described in connection with this embodiment, it is to be understood that this embodiment could include the same number of projections as resilient seals.

Body portion 824 includes a proximal end 832, a distal end 834, a flat surface 836 extending between proximal and distal ends 832, 834, and a pair of cylindrically-shaped pivot pins 837 extending laterally away from proximal end 832, as shown in FIGS. 21–22.

Figure 23:
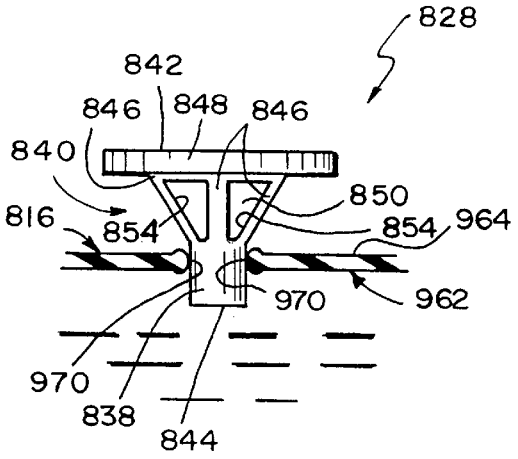
FIG. 23 is an enlarged view of the projection and the resilient seal of FIG. 22 showing the resilient seal (shown in section) embracing the plug portion of the projection therearound in the closed position.

Projection 828 is structurally similar in many respects to projection 828 described in connection with the "lift-action" embodiment in that it includes a cylindrically-shaped plug portion 838 and a conically-shaped cage portion 840, as shown in FIG. 23. However, cage portion 840, instead of plug portion 838, is coupled to body portion 824 so that cage portion 840 is positioned to lie above plug portion 838. Projection 828 also includes a proximal end 842 and a distal end 844. Proximal end 842 couples to flat surface 836 of body portion 824 at distal end of body portion 824 such that projection 828 extends downwardly from flat surface 836 of body portion 824. Cage portion 840 extends from proximal end 842 to plug portion 838. Plug portion 838 extends from cage portion 840 to distal end 844. The diameter of distal end 844 is smaller than the diameter of proximal end 842.

Cage portion 840 includes a plurality of fingers 846 and an annular mount section 848 that couples to flat surface 836 at proximal end 842 of projection 828. Fingers 846 cooperate to define a cavity 850 inside of the "cone" of cage portion 840. Each finger 846 includes an end coupled to plug portion 838 and an opposite end coupled to mount section 848. Mount section 848 extends between and radially outwardly from opposite ends of fingers 846. Fingers 846 and mount section 848 are arranged to form orifices 854 therebetween.

Base 822 integrally includes a horizontal, circular plate 882 that extends across the opening of receptacle 812, a rim 884 coupled to the perimeter of plate 882, and a pair of upstanding pivot supports 886 coupled to plate 882, as shown in FIGS. 21–22. Rim 884 is conventional in design and couples base 822 to receptacle 812 in a conventional manner.

Plate 882 is positioned below body portion 824 and is structurally similar to plate 882 described in connection with the "lift-type" actuator 820 embodiment. Well 898 is similar in structure to the wells of the prior embodiments so that like reference numbers refer to like structures. Well 898 is formed to include elliptically-shaped inner edge 948. Inner edge 948 defines elliptically-shaped seal-receiving aperture 942 and includes tongue 958 that extends around inner edge 948 and provides additional surface area to which resilient seal 816 bonds. Well 898 is positioned to lie lower than plateau region 892.

Pivot supports 886 are coupled to plateau region 892 and are generally C-shaped. Each pivot support 886 is arranged to formed an opening 888 and an aperture 890 that is sized to receive respective pivot pin 837. Pivot pins 837 are rotatably coupled to respective pivot support 886 so that actuator 820 is pivotally coupled to base 822 for pivotal movement around a pivot axis 891 extending through pivot pins 837. Pivot pins 837 are coupled to pivot supports 886 by placing each pivot pin 837 on respective pivot support 886 in respective opening 888 and then pressing each pivot pin 837 downwardly into respective aperture 890.

Resilient seal 816 is structurally similar to the resilient seals described in connection with the prior embodiments so that like reference numbers refer to like structures, as shown in FIGS. 21–22. Outer portion 968 of resilient seal 816 bonds to inner edge 948 of well 898. Inner portion 970 of web region 962 of resilient seal 816 defines projection-receiving aperture 972. Projection 828 nests within projection-receiving aperture 972 as will be more fully described below. Projection-receiving aperture 972 is positioned to lie in concentric relation to outer portion of resilient seal 816 and well 898 when actuator 820 is closed. Upper surface 964 of first resilient seal 816 is generally flat when actuator 820 is closed and is positioned to lie flush with well 898. Upper surface 964 of resilient seal 816 and flat surface 836 of body portion 824 cooperate to define a flow chamber 976 therebetween. Flow chamber 976 permits communication between resilient seal 816 and distal end 834 of body portion 824. Lower rim surface 978 of resilient seal 816 is positioned to lie flush with well 898.

Figure 24:
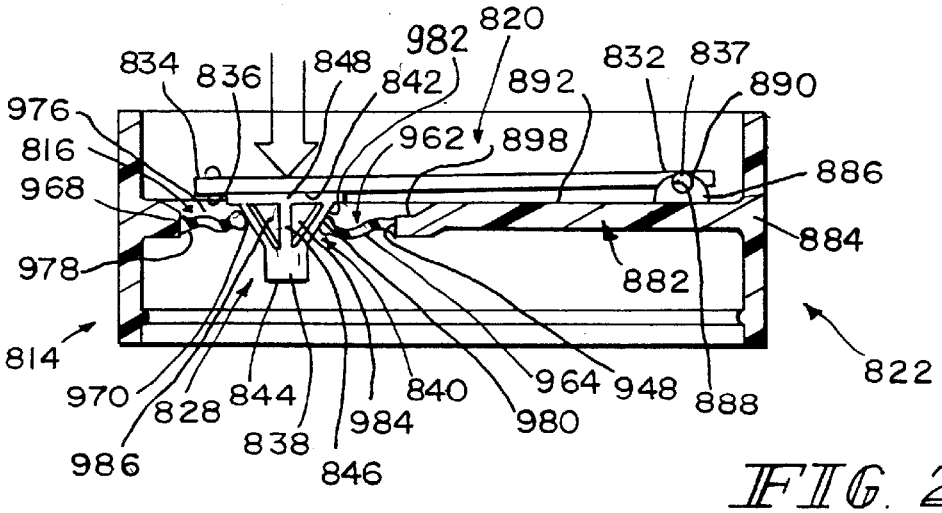
FIG. 24 is a sectional view of the lid of FIG. 22 showing the lid in the opened position, the projection having been "pushed down" so that the cage portion couples to the resilient seal to form a first set of flow passages below the resilient seal and a second set of flow passages above the resilient seal.

In operation, actuator 820 is pivotally coupled to base 822 for movement between the closed, or no-flow, position, as shown in FIG. 22, to the opened, or flow, position, as shown in FIG. 24.

When actuator 820 is in the closed position, plug portion 838 of projection 828 is positioned to lie within projection-receiving aperture 972 and inner portion 970 of resilient seal 816 slidably couples to plug portion 838, as shown in FIGS. 22–23. More particularly, inner portion 970 of resilient seal 816 embraces plug portion 838 so that inner portion 970 adjoins plug portion 838 therearound to form a substantially flow-tight seal therewith. The diameter of plug portion 838 is slightly greater than the diameter of projection-receiving aperture 972 when nothing is positioned in projection-receiving aperture 972 so that such a flow-tight seal is obtained when plug portion 838 is positioned in projection-receiving aperture 972. In the closed position, cage portion 840 of projection 828 is positioned to lie outside of projection-receiving aperture 972 and the interior region of receptacle 812 above inner portion 970 of resilient seal 816 so that orifices 854 cannot conduct fluid out of receptacle 812. Furthermore, resilient seal 816 is positioned to lie horizontally in the closed position.

To dispense fluid from receptacle 812, a user applies a sufficient actuating force to distal end 834 of body portion 824 to pivot actuator 820 from the closed position to the opened position, as shown in FIG. 24, so that fluid can flow through orifices 854 of cage portion 840 out of receptacle 812 when the user simply tilts container. A user pushes downwardly on body portion 824 so that body portion 824 pivots about pivot axis 891 thereby pushing projection 828 downwardly and substantially perpendicularly to the plane of projection-receiving aperture 972. Moving projection 828 in this manner causes plug portion 838 to slide through projection-receiving aperture 972 while inner portion 970 continues to adjoin plug portion 838 therearound. As body portion 824 continues to push projection 828 downwardly, cage portion 840 slidably couples to inner portion 970 so that plurality of fingers 846 of cage portion 840 adjoins inner portion 970 to deform inner portion 970. More particularly, due to the conical geometry of cage portion 840, as cage portion 840 is pushed through projection-receiving aperture 972, plurality of fingers 846 gradually stretch inner portion 970 radially outwardly from the center of projection-receiving aperture 972 to enlarge projection-receiving aperture 972.

Figure 25:
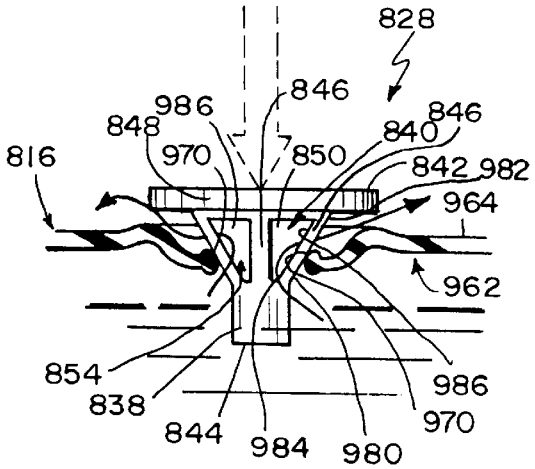
FIG. 25 is an enlarged view of the projection and the resilient seal of FIG. 24 showing the cage portion of the projection coupling to the resilient seal (shown in section) so that fluid can flow through the resilient seal by passing through the first and second sets of flow passages.

In the opened position, plug portion 838 is positioned to lie entirely inside of the interior region of receptacle 812 while a first part 980 of cage portion 840 is positioned to lie in the interior region of receptacle 812 and a second part 982 of cage portion 840 is positioned to lie above inner portion 970 of resilient seal 816 inside of flow chamber 976 and outside of the interior region of receptacle 812, as shown in FIG. 25. Moreover, first part 980 of cage portion 840 and inner portion 970 of resilient seal 816 cooperate to define a first set of flow passages 984 and second part 982 of cage portion 840 and inner portion 970 of resilient seal 816 cooperate to define a second set of flow passages 986. In the opened position, when the user simply tilts container 810, fluid can flow out of the interior region of receptacle 812 through resilient seal 816 by passing through first set of flow passages 984 into cavity 850 of cage portion 840, through projection-receiving aperture 972, and out of cavity 850 of cage portion 840 through second set of flow passages 986 into flow chamber 976 and ultimately to the exterior of container 810 for user consumption. At the same time, first and second sets of flow passages 984, 986 permit ambient air to flow from flow chamber 976 through resilient seal 816 into the interior region of receptacle 812 to minimize any incipient "vacuum " condition that may develop. Similar to the prior embodiments, the user can vary the relative sizes of first and second sets of flow passages 984, 986 by the amount of force the user applies to lever 826 to control the amount of fluid dispensed per unit time.

When the user removes the actuating force from body portion 824, resilient seal 816 urges projection 828 back to the closed position. Resilient seal 816 provides the sole spring return force to move projection 828 back to the closed position while the conical geometry of cage portion 840 provides the unstable condition that occasions the spring return of resilient seal 816. More particularly, when the actuating force is removed, inner portion 970 of resilient seal 816 slidably couples to plurality of fingers 846 to squeeze cage portion 840 so that cage portion 840 is again positioned above inner portion 970 of resilient seal 816 outside of the interior region of receptacle 812. At the same time, plug portion 838 reenters projection-receiving aperture 972 and inner portion 970 again adjoins plug portion 838 therearound to form a flow-tight seal therewith to prohibit fluid from passing through projection-receiving aperture 972. Furthermore, resilient seal 816 continuously biases actuator 820 toward the closed position.

As projection 828 slides back and forth against inner portion 970 of resilient seal 816 between the closed and opened positions, inner portion 970 wipes projection 828. This wiping effect aids in removing substances, such as granulated particles, pellets, and powdered materials, for example, from between projection 828 and inner portion 970 of resilient seal 816 that could adversely affect the desired seal between projection 828 and inner portion 970.

Figure 26:
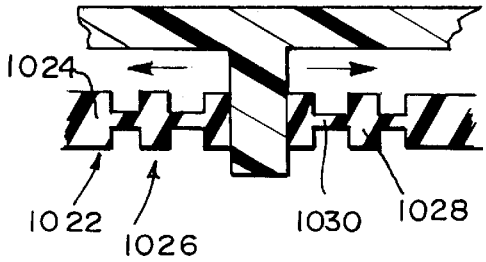
FIG. 26 is a sectional view of an alternative embodiment of the resilient seal of the present invention showing the resilient seal including alternating thick and thin portions.

According to an alternative embodiment of resilient seals, a resilient seal includes a rim region 1024 and a web region 1026 that includes alternating thick portions 1028 and thin portions 1030, as show in FIG. 26. Alternating thick and thin portions 1028, 1030 aid in controlling the manner in which projections flex web region 1026.

Figure 27:
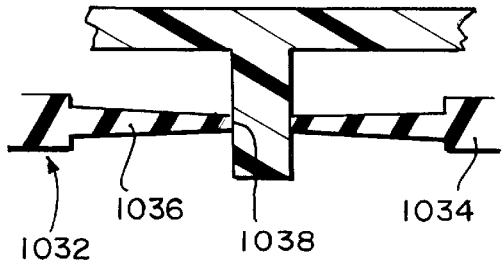
FIG. 27 is a sectional view of an alternative embodiment of the resilient seal of the present invention showing the resilient seal tapering in thickness toward an inner section.
Figure 28:
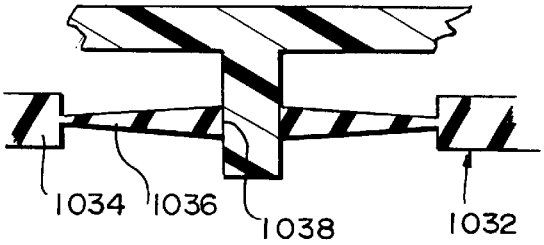
FIG. 28 is a sectional view of an alternative embodiment of the resilient seal of the present invention showing the resilient seal tapering in thickness from an inner portion.

According to another alternative embodiment of resilient seals, a resilient seal 1032 includes a rim region 1034 and a tapering web region 1036. Illustratively, the thickness of web region 1036 decreases from rim region 1034 to an inner portion 1038 of web region 1036, as shown in FIG. 27. Illustratively, in an alternative embodiment of web region 1036, the thickness of web region 1036 gradually increases from rim region 1034 to inner portion 1038 of web region 1036, as shown in FIG. 28.

Figure 29:
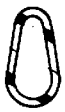
FIG. 29 is a sectional view of an alternative embodiment of the projection of the present invention having a pear shape.
Figure 30:
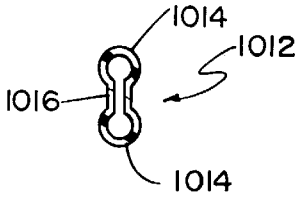
FIG. 30 is a sectional view of an alternative embodiment of the projection of the present invention having a dumb bell shape.
Figure 31:
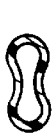
FIG. 31 is a sectional view of an alternative embodiment of the projection of the present invention having an hour-glass shape.
Figure 32:
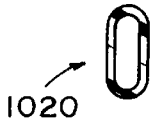
FIG. 32 is a sectional view of an alternative embodiment of the projection of the present invention having a substantially uniform thickness.

It is to be understood that alternative embodiments of the projections are within the scope of the present invention. For example, a projection 1010 is provided having a pear-shaped cross-section as shown in FIG. 29. FIG. 30 shows another projection 1012 having a dumb bell-shaped cross-section where the cross-section includes a pair of spaced circles 1014 of equal diameter that are linked by a branch 1016 of uniform thickness that is shorter than the diameter of circles 1014. A projection 1018 is provided having an hour-glass cross-section, as shown in FIG. 31. A projection 1020 with an elongated cross-section having a substantially uniform thickness is shown in FIG. 32.

Although the present invention has been described with reference to a beverage container containing a fluid, it is to be understood, as previously mentioned, that the self-closing lid may be used to dispense other types of materials including, for example, non-liquid materials, powders, granulated materials, pelletized materials, etc., from other types of containers.

Although the illustrated embodiments are disclosed with reference to the resilient seals being positioned to lie horizontally when the container is upstanding, it is to be understood that the resilient seals can be coupled to container to assume any attitude relative to container such as being positioned to lie vertically, angularly, or the like.

Although the illustrated embodiments are disclosed in connection with various types of actuators (or actuation means), it is to be understood that other types of actuators, or actuation means, are within the scope of the present invention for moving the resilient seals between the normally closed, or no-flow, position and the opened, or flow, position to dispense the contents of a container.

It is to be understood that the present invention is operable using only one resilient seal or more than one resilient seal.

Although the invention has been described in detail with reference to certain embodiments, variations and modifications exist within the scope and spirit of the invention as described and as defined in the following claims.

What is claimed is:

1. A lid adapted to close a container comprising:

a base adapted to couple to the container, an actuator including a body portion and a projection extending away from the body portion, and a resilient seal coupled to the base, the resilient seal providing a projection-receiving aperture, the projection being inserted in the projection-receiving aperture, the projection being coupled to the resilient seal to form a flow-tight seal therewith when the actuator is positioned in a normally closed position relative to the base, the projection being coupled to the resilient seal to deform the resilient seal relative to the closed position to form a flow passage therebetween when the actuator is positioned in an opened position relative to the base.

2. The self-closing lid of claim 1, wherein the resilient seal is coupled to the projection to embrace the projection when the actuator is closed and the projection couples to the resilient seal to enlarge the projection-receiving aperture relative to the closed position to form the flow passage when the actuator is opened.

3. The self-closing lid of claim 2, wherein the resilient seal is made of a resilient material so that the resilient seal substantially recovers its shape when the actuator returns to the closed position.

4. The self-closing lid of claim 3, wherein the resilient seal is made of an elastomeric material.

5. The self-closing lid of claim 4, wherein the resilient seal is made of polyolefin.

6. The self-closing lid of claim 4, wherein the resilient seal is made of silicone.

7. The self-closing lid of claim 4, wherein the resilient seal is made of polystyrene.

8. The self-closing lid of claim 2, wherein the resilient seal includes an outer portion that defines the perimeter of the resilient seal and couples to the base and an inner portion that defines the projection-receiving aperture.

9. The self-closing lid of claim 8, wherein the outer portion is elliptically-shaped and the inner portion is circularly-shaped when the actuator is closed.

10. The self-closing lid of claim 8, wherein the projection stretches the projection-receiving aperture to form the flow passage.

11. The self-closing lid of claim 10, wherein a portion of the projection adjoins a portion of the inner portion and an opposite portion of the projection and an opposite portion of the inner portion cooperate to define the flow passage when the actuator is opened.

12. The self-closing lid of claim 10, wherein the projection adjoins the inner portion to stretch the inner portion radially outwardly from the center of the projection-receiving aperture relative to the closed position when the actuator is opened.

13. The self-closing lid of claim 8, wherein the distance between the inner portion and the outer portion in the direction of movement of the projection between the closed and opened positions of the actuator is substantially greater than the thickness of the resilient seal.

14. The self-closing lid of claim 13, wherein the thickness of a portion of the resilient seal is substantially constant when the actuator is closed.

15. The self-closing lid of claim 13, wherein a portion of the resilient seal tapers in thickness when the actuator is closed.

16. The self-closing lid of claim 15, wherein the tapered portion of the resilient seal is most thick at the inner portion of the resilient seal when the actuator is closed.

17. The self-closing lid of claim 15, wherein the tapered portion of the resilient seal is least thick at the inner portion of the resilient seal when the actuator is closed.

18. The self-closing lid of claim 13, wherein the resilient seal includes portions of alternating thickness when the actuator is closed.

19. The self-closing lid of claim 2, wherein the resilient seal continuously biases the actuator toward the closed position.

20. The self-closing lid of claim 1, wherein the actuator is coupled to the base for rotatable movement relative to the base.

21. The self-closing lid of claim 20, wherein the actuator further includes a connector that couples to and extends downwardly from the middle of the body portion and the base is formed to include a connector-receiving aperture, the connector being inserted in the connector-receiving aperture for rotatable movement of the actuator relative to the base.

22. The self-closing lid of claim 20, wherein the body portion includes an upper surface, a lower surface, and a circular perimeter edge, the perimeter edge being formed to include a notch, the projection being coupled to the resilient seal to enlarge the projection-receiving aperture to form the flow passage between the projection and the resilient seal.

23. The self-closing lid of claim 22, wherein the lower surface of the body portion, the upper surface of the resilient seal, and the base cooperate to form a flow chamber therebetween to permit flow communication between the notch and the flow passage formed between the projection and the resilient seal.

24. The self-closing lid of claim 22, wherein the projection is coupled to the lower surface of the body portion and is disposed offset from an axis extending between the center of the body portion and the center of the notch.

25. The self-closing lid of claim 24, wherein the notch is rotated so that the flow passage formed between the projection and the resilient seal is aligned directly below the axis extending between the center of the body portion and the center of the notch when the actuator is opened.

26. The self-closing lid of claim 1, wherein at least a portion of the actuator is slidably coupled to the base for movement of the body portion along a longitudinal axis of the body portion relative to the base.

27. The self-closing lid of claim 26, wherein the base includes at least one L-shaped guide tab that slidably couples to the actuator for the longitudinal movement of the body portion relative to the base.

28. The self-closing lid of claim 26, wherein the body portion includes a lateral edge and the body portion, the resilient seal, and the base cooperate to form a flow chamber therebetween to permit flow communication between the lateral edge of the body portion and the flow passage formed between the projection and the resilient seal.

29. The self-closing lid of claim 1, wherein the actuator is pivotally coupled to the base and is adapted to receive an actuating force sufficient to position the actuator in the opened position.

30. The self-closing lid of claim 1, wherein the actuator further includes a lever that couples to and extends from the body portion, the lever being adapted to receive an actuating force sufficient to position the actuator in the opened position.

31. The self-closing lid of claim 30, wherein the body portion of the actuator includes an upper surface and a lower surface, the lever being coupled to the upper surface.

32. The self-closing lid of claim 30, wherein the lever is pivotally coupled to the base and to the body portion.

33. The self-closing lid of claim 1, wherein the projection includes a proximal and a distal end, the proximal end being coupled to the body portion of the actuator.

34. The self-closing lid of claim 33, wherein the projection is cylindrically-shaped so that the projection has a circular cross-section.

35. The self-closing lid of claim 33, wherein the projection includes a cylindrically-shaped first portion and a conically-shaped second portion, the first portion being coupled to the resilient seal to form a flow-tight seal therewith when the actuator is closed, the second portion being coupled to the resilient seal to enlarge the projection-receiving aperture relative to the closed position to form the flow passage when the actuator is opened.

36. The self-closing lid of claim 35, wherein the second portion includes a plurality of fingers, the plurality of fingers and the resilient seal cooperating to form a plurality of flow passages therebetween when the actuator is opened.

37. The self-closing lid of claim 35, wherein the first portion extends from the proximal end of the projection to the second portion and the second portion extends from the first portion to the distal end of the projection.

38. The self-closing lid of claim 35, wherein the second portion extends from the proximal end of the projection to the first portion and the first portion extends from the second portion to the distal end of the projection.

39. A self-closing lid adapted for a container comprising:

a base adapted to fit an opening of the container and to couple to the container to form a flow-tight seal therewith, an actuator including a projection, and a resilient seal coupled to the base, the projection being coupled to the resilient seal to form a flow-tight seal therewith when the actuator is positioned in a normally closed position relative to the base, the projection deforming the resilient seal relative to the closed position to form a flow passage therebetween when the actuator is positioned in an opened position relative to the base, the resilient seal biasing the actuator toward the closed position.

40. The self-closing lid of claim 39, further comprising a second resilient seal and wherein the actuator further includes a second projection, the second projection being coupled to the second resilient seal to form a flow-tight seal therewith when the actuator is closed, the second projection deforming the second resilient seal relative to the closed position to form a flow passage therebetween when the actuator is opened, the second resilient seal biasing the actuator toward the closed position.

41. The self-closing lid of claim 40, wherein each resilient seal includes an outer portion and an inner portion, each outer portion being coupled to the base, each inner portion defining a projection-receiving aperture, each projection being positioned to lie within the respective projection-receiving aperture.

42. The self-closing lid of claim 41, wherein each inner portion embraces the respective projection so that each inner portion adjoins the respective projection therearound when the actuator is closed.

43. The self-closing lid of claim 41, wherein each projection is coupled to the respective resilient seal to stretch the respective inner portion relative to the closed position to form the respective flow passage when the actuator is opened.

44. The self-closing lid of claim 40, wherein the resilient seals are positioned to lie in co-planar relation to each other when the actuator is closed.

45. The self-closing lid of claim 40,wherein the actuator further includes a body portion, the projections being coupled to the body portion and positioned to lie offset from a diametrical axis of the body portion, the projections being moved arcuately relative to the center of the body portion between the closed and opened positions of the actuator.

46. The self-closing lid of claim 40, wherein the actuator includes a body portion having a longitudinal axis, the projections being coupled to the body portion and positioned to lie in spaced-apart relation to each other along the longitudinal axis of the body portion, the projections being moved along the longitudinal axis of the body portion relative to the base between the closed and opened positions of the actuator.

47. The self-closing lid of claim 39, wherein the resilient seal is formed to include a projection-receiving aperture, the projection being positioned to lie within the projection-receiving aperture, the projection being moved along an axis substantially perpendicular to the plane of the projection-receiving aperture between the closed and opened positions of the actuator.

48. A self-closing lid adapted to couple to a container comprising:

a base adapted to extend across an opening of the container and to couple to the container, a resilient portion coupled to the base and formed to include an aperture, and actuation means, including a projection that is positioned to engage the aperture, for deforming the resilient portion between a normal no-flow position when the projection couples to the resilient portion to form a flow-tight seal therewith and a flow position when the projection deforms the resilient portion relative to the no-flow position to form a flow passage therebetween.

49. The self-closing lid of claim 48, wherein the resilient portion includes a portion that defines the aperture, the portion defining the aperture adjoining the projection therearound when the resilient portion is positioned in the no-flow position, the projection being coupled to the resilient portion to stretch the portion of the resilient portion defining the aperture to enlarge the aperture relative to the no-flow position to form the flow passage when the resilient portion is positioned in the flow position.

50. The self-closing lid of claim 49, wherein the projection moves a portion of the portion of the resilient portion defining the aperture away from an opposite portion of the portion of the resilient portion defining the aperture during movement of the resilient portion from the no-flow position to the flow position.

51. The self-closing lid of claim 49, wherein the projection moves the portion of the resilient portion defining the aperture radially outwardly from the center of the aperture during movement of the resilient portion from the no-flow position to the flow position.

52. The self-closing lid of claim 48, wherein the resilient portion is made of a resilient material so that the resilient portion is biased toward the no-flow position.

53. The self-closing lid of claim 52, wherein the resilient portion is made of an elastomeric material.

54. The self-closing lid of claim 48, further comprising a second resilient portion coupled to the base and formed to include an aperture and wherein the actuation means further includes a second projection that is coupled to the second resilient portion and is positioned to lie within the aperture of the second resilient portion.

55. A lid for a container having an opening, the lid being proportioned and designed to close the opening, the lid comprising:

a base adapted to fit the container opening, the base having a deformable portion which, when deformed, will pass the contents of the container therethrough, and an actuator being moveable between a closing position and an opening position, the actuator being operable to deform the deformable portion such that, when the actuator is in its closing position, the contents of the container are blocked from passing through the deformable portion and, when the actuator is in its opening position, the contents of the container pass through the deformable portion.

* * * * *